US006216608B1

(12) United States Patent
Woods et al.

(10) Patent No.: US 6,216,608 B1
(45) Date of Patent: Apr. 17, 2001

(54) PLASTIC PALLET

(75) Inventors: Martin E. Woods, Westlake; Craig L. Shoemaker, Avon; David W. Taylor, Medina; Patrick C. Booth, Elyria, all of OH (US)

(73) Assignee: The Geon Company, Avon Lake, OH (US)

( * ) Notice: Subject to any disclaimer, the term of this patent is extended or adjusted under 35 U.S.C. 154(b) by 0 days.

(21) Appl. No.: 09/334,351

(22) Filed: Jun. 16, 1999

Related U.S. Application Data

(60) Provisional application No. 60/091,376, filed on Jul. 1, 1998.

(51) Int. Cl.[7] ..... B65D 19/38

(52) U.S. Cl. ..... 108/57.25; 108/56.1

(58) Field of Search ..... 108/57.25, 57.26, 108/51.11, 51.3, 901, 902, 56.1

(56) References Cited

U.S. PATENT DOCUMENTS

| | | | | |
|---|---|---|---|---|
| Re. 32,530 | | 10/1987 | Cantey, Jr. . | |
| 3,603,272 | | 9/1971 | Und Stanswerk et al. . | |
| 3,610,172 | | 10/1971 | Wharton . | |
| 3,700,205 | | 10/1972 | Ditges . | |
| 3,702,100 | | 11/1972 | Wharton . | |
| 3,835,792 | | 9/1974 | Wharton . | |
| 3,878,796 | | 4/1975 | Morrison . | |
| 3,917,108 | | 11/1975 | Thurman . | |
| 3,938,448 | | 2/1976 | Nishitani et al. . | |
| 3,938,818 | | 2/1976 | Studeny et al. . | |
| 3,989,156 | | 11/1976 | Lowry . | |
| 4,051,787 | | 10/1977 | Nishitani et al. . | |
| 4,230,049 | | 10/1980 | Horne . | |
| 4,482,051 | | 11/1984 | Cantey, Jr. . | |
| 4,714,026 | * | 12/1987 | Yamaguchi et al. | 108/51.3 X |
| 4,799,433 | | 1/1989 | Luft . | |
| 4,809,618 | | 3/1989 | Bell . | |
| 4,843,976 | | 7/1989 | Pigott et al. . | |
| 5,184,558 | * | 2/1993 | Wozniacki | 108/51.3 |
| 5,197,395 | | 3/1993 | Pigott et al. . | |
| 5,219,629 | | 6/1993 | Sobolev . | |
| 5,238,633 | | 8/1993 | Jameson . | |
| 5,259,169 | | 11/1993 | Appelbaum et al. . | |
| 5,312,858 | | 5/1994 | Folsom . | |
| 5,365,859 | * | 11/1994 | Schrage | 108/901 X |
| 5,405,567 | | 4/1995 | Needham et al. . | |
| 5,413,052 | * | 5/1995 | Breezer et al. | 108/57.25 X |
| 5,417,167 | * | 5/1995 | Sadr | 108/901 X |
| 5,435,954 | | 7/1995 | Wold . | |
| 5,440,998 | * | 8/1995 | Morgan, IV et al. | 108/901 X |
| 5,456,189 | | 10/1995 | Isle . | |
| 5,458,069 | * | 10/1995 | Stolzman | 108/901 X |
| 5,505,141 | | 4/1996 | Barber . | |
| 5,527,585 | | 6/1996 | Needham et al. . | |
| 5,547,081 | | 8/1996 | Mullock et al. . | |
| 5,704,300 | | 1/1998 | Rushton et al. . | |
| 5,829,364 | * | 11/1998 | Urbach | 108/51.11 X |
| 5,836,255 | * | 11/1998 | Uitz | 108/57.25 |
| 5,879,495 | | 3/1999 | Evans . | |

* cited by examiner

*Primary Examiner*—Jose V. Chen
(74) *Attorney, Agent, or Firm*—Ralph E. Jocke; Joe A. Powell

(57) ABSTRACT

A plastic pallet (10) having good load bearing construction and held together without mechanical fasteners, includes deck boards (30). The deck boards include ridges (24) on an upper side (32) and a lower side (34) thereof. Deck boards are positioned transversely on stringers (12) and joined thereto by either an adhesive or thermoplastic welding processes. The stringers and deck boards may be provided with end caps (26, 42) which seal interior areas of the stringers and deck boards and prevent tearing thereof. The stringers and deck boards have interior reinforcement ribs (22,40). The cross sectional profiles of the stringers, deck boards, and end caps provide a cost effective and light weight pallet. Openings which extend between the stringers allow for either two way fork entry and/or four way fork entry. The stringers and deck boards provide flexibility in constructing pallets of various designs. The plastic pallet preferably is highly durable and fully recyclable.

49 Claims, 17 Drawing Sheets

PLASTIC PALLET

This application claims benefit of provisional application 60/091,376 filed Jul. 1, 1998.

TECHNICAL FIELD

This invention relates in general to a plastic pallet. Specifically, this invention relates to a plastic pallet which is a general purpose shipping pallet formed from a thermoplastic material and assembled without any mechanical fasteners.

BACKGROUND ART

Shipping pallets are well known in the art. Pallets are typically made of wood and used for supporting various items. They are constructed to be handled with a forklift or similar lifting device within a plant, a warehouse, or loading dock. There are several disadvantages to wood pallets. These disadvantages include the weight of the pallet and their susceptibility to breakage during use. In addition, wood is subject to deterioration that occurs with age and exposure to weather. Wood is also subject to attack by insects, mold and bacteria. There is the potential for damage to the pallet caused by spills from the goods that the pallets are bearing, for example a chemical spill or even physical damage from heavy loads. As a result, pallets are often discarded at waste sites and landfills. Contaminated wood pallets may present potential environmental hazards. The limited availability of the natural resources used to make the wood pallets is also a concern in many parts of the world. Also, wood pallets are not very hygienic for food and medical applications.

Metal pallets are also available, but have several drawbacks including their expense, susceptibility to corrosion, potentially poor chemical resistance and weight. When corroded, metal pallets are not very hygienic for food or medical applications either.

There have been many attempts to produce plastic pallets which are available in numerous shapes and forms. Industry has looked to plastic as an alternative to wood or metal for a number of reasons including the superior chemical resistance of plastic over wood or metal, the hygienic quality of plastic over wood or metal, the weight advantage of plastic, and the fact that some configurations of plastic pallets are less expensive to manufacture. In addition, plastic provides a major uniformity and consistency advantage in material over wood.

U.S. Pat. No. 5,704,300 describes a plastic pallet which is held together with mechanical fasteners. U.S. Pat. Nos. 5,527,585 and 5,405,567 describe plastic molded load-bearing structures. These patents describe structures fabricated from usually dissimilar plastic materials such as a deck sheet with downward extending feet that may be made removable so as to have a snap fit attachment.

Other patents describing plastic pallets of particular shapes and designs include U.S. Pat. Nos. 5,456,189; 5,505,141; 5,197,395; 4,843,976; 4,482,051 (Pat. No. Re. 32,530); 4,051,787; 3,989,156; 4,809,618; 4,799,433; 3,938,818; 3,938,448; 3,835,792; 3,702,100; 3,700,205; 3,610,172; and 3,603,272. The foregoing patents describe the advantages of a plastic pallet over the prior art wood pallet and describe pallets of various designs and shapes as well as methods for forming them.

Another approach has been to provide plastic laminates or panels such as taught in U.S. Pat. No. 5,219,629. Alternately, there have been attempts to make composite structural systems from plastics or some other reinforced composite material as described in U.S. Pat. Nos. 4,230,049 and 5,435,954. Other patents of interest that teach and describe fabricating or molding various shapes using plastic material include U.S. Pat. Nos. 5,547,081; 5,312,858; 5,259,169; 5,238,633; and 3,917,108.

U.S. Pat. No. 3,878,796 describes a plastic pallet assembly which includes boards and stringers that are held in an interlocked relationship with an arrangement of integral notches and shoulders.

There still exists a need for a plastic pallet that is simple in construction and easy to fabricate that has load bearing capability at least comparable to a wooden pallet. The plastic pallet would preferably have extruded thermoplastic members which are economical and lightweight. Advantageously, the extruded members include thermoplastic deck boards and stringers which provide design flexibility in fabricating pallets of various configurations and sizes. The plastic pallet may include stringers that have end caps that seal the ends of the extruded profiles and which provide added strength and durability. Preferably, the pallets would be constructed of a thermoplastic material that allows for a long useful life and complete recycling. The plastic pallet preferably would be constructed using a joining technology that does not require mechanical fasteners. Preferably such a plastic pallet would include ridges or other non-slip members on its deck boards and/or stringers. The ridges or other members may function to reduce slippage. The ridges may also function as energy concentrators for welding, may provide adhesive gap control when adhesives are employed as the joining technology, and may serve as mechanical interlocks during pallet storage and shipment. Preferably, the plastic pallet configurations may allow either four-way fork entry or two-way fork entry by a forklift or hand truck to facilitate stacking, lifting, and handling of the pallet. The profiles of the deck boards may in some embodiments include chamfers at desired locations for facilitating fork entry and exit from the pallet.

DISCLOSURE OF INVENTION

It is an object of the present invention to provide a plastic pallet that is constructed of a thermoplastic material capable of being reused and recycled.

It is a further object of the present invention to provide a plastic pallet having deck boards with ridges so as to reduce slippage, to act as an energy concentrator for welding, to provide adhesive gap control when adhesives are used for the joining technology, and/or to provide interlocks during pallet storage and shipment.

It is a further object of the present invention to provide a plastic pallet that is extruded so as to be less expensive and lightweight, and still exhibit sufficient load bearing capacity.

It is a further object of the present invention to construct the plastic pallet with a joining technology that does not require any mechanical fasteners so as to minimize potential tear points and to allow for direct recycling.

It is a further object of the present invention to provide a plastic pallet constructed from extruded profiles that offer design flexibility for making a wide variety of pallets in various sizes and shapes.

It is a further object of the present invention to provide a plastic pallet produced in a block style with four way fork entry.

It is a further object of the present invention to provide a plastic pallet with deck boards that have a chamfer at desired locations.

It is a further object of the present invention to provide rib reinforced deck boards and stringers for a plastic pallet.

It is a further object of the present invention to provide an automated process for constructing a plastic pallet of a variety of designs from basically two building blocks, the deck boards and stringers.

It is a further object of the present invention to provide a plastic pallet having deck boards and stringers constructed of different thermoplastic materials for providing a desired degree of toughness, rigidity, and durability.

It is a further object of the present invention to provide a plastic pallet that can include a variety of shock absorbers for improving impact strength including but not limited to bumper strips on edge boards, resilient blocks between boards, and/or semi-rigid or flexible end caps.

It is a further object of the present invention to provide a plastic pallet constructed for operation with either two-way or four-way fork entry for facilitating loading and stacking of the pallets.

It is a further object of the present invention to provide end caps for the stringers and the deck boards for reducing areas of contamination by bacteria, fungi, mold, insects, dirt, and the like.

It is a further object of the present invention to provide a plastic pallet that includes removable end caps for the stringers to provide additional compartments for identification purposes, or to provide variable weight to control the stability of the pallet and the material thereon.

It is a further object of the present invention to provide a plastic pallet with end caps that include identifying means such as a bar code, processor chips, or the like.

It is a further object of the present invention to provide a plastic pallet which is simple in design, rugged in construction, and economical to manufacture.

It is a further object of the present invention to provide deck boards with surfaces that exhibit greater traction and resistance to slippage through the use of features which resist movement such as dimpled surfaces, sinusoidal shaped ridges, intermittent ridges across boards, non-slip members or a co-extruded layer of high coefficient of friction as a surface layer.

It is a further object of the present invention to provide a plastic pallet that includes ridges on the stringers to facilitate construction of a pallet held together by hot plate welding.

Further objects of the present invention will be made apparent following the Best Modes for Carrying Out Invention and the appended claims.

The foregoing objects of the present invention are accomplished by a plastic pallet. The pallet is constructed of a plurality of longitudinal spaced apart stringers having deck boards joined thereto without mechanical fasteners. Each of the stringers are formed from a thermoplastic material and in cross section have a pair of longitudinal walls connected by a top surface and a bottom surface. Each of the stringers includes an interior area defined by the walls and the top and bottom surfaces. Each of the stringers further has at least one and preferably a plurality of reinforcement ribs extending in the interior area thereof. The reinforcement ribs preferably have radiused corner surfaces where they join the walls or top and bottom surfaces. The ribs preferably include ribs having an orientation substantially perpendicular to the longitudinal walls.

A plurality of longitudinal spaced apart deck boards also formed of a thermoplastic material are situated transversely on the stringers. Each of the deck boards includes in cross section an upper side and a lower side connected with side walls through radiused corners. The sides and walls define an interior area. A plurality of reinforcement ribs are situated in the interior area. The ribs also preferably include radiused corner surfaces where they join the sides and walls. The ribs have a preferred direction that is substantially perpendicular to the upper and lower sides. Preferably, the deck boards include ridges on the upper and lower sides thereof. The ridges may serve to reduce slippage, provide a better bonding surface and adhesive gap control, and/or act as energy concentrators for welding the deck boards to the stringers. The ridges may also function as physical interlocks during pallet storage and shipment. Deck boards are joined to the top surfaces as well as on the bottom surfaces of the stringers to provide a pallet structure having sufficient load bearing capacity. Preferably, the deck boards are positioned adjacent the ends of the stringers with the edges of the side walls of the stringers generally aligned with the ends of the stringers, or with the face of end caps which may be positioned on the ends of the stringers.

In an alternate embodiment according to the present invention, the stringers include a plurality of ridges on their top and bottom surfaces. The ridges may facilitate attachment to the deck boards when they are joined with hot plate welding. Alternatively, the top and bottom surfaces of the stringers may include other suitable features to enhance engagement of the boards and stringers.

The plastic pallet in accordance with the present invention may optionally include removable end caps for the stringers and/or deck boards. The end caps preferably seal the interiors of the stringers and deck boards against contamination and damage. The end caps may also include an identification means for identifying the pallet or the material supported on the pallet, such as a bar code, processor chips, or other identifying indicia.

Alternative embodiments of the invention may include end caps for the stringers which help maintain structural integrity and increase durability of the pallet. The end caps preferably close the interior area of the stringers at each end. The end caps preferably include projecting portions which extend adjacent to and in fixed engagement with the longitudinal walls and/or the top and bottom surfaces of the stringers. The projecting portions extend in engagement with the walls or surfaces a substantial distance inwardly from the end of the stringer to provide reinforcement in the end area. Such reinforcement helps to minimize damage due to engagement of the end caps and stringer ends with the forks of lift and hand trucks. The projecting portions of the end caps may extend externally or internally of the stringers. The end caps may be fixed to adjacent deck boards as well as to the stringers.

Advantageously, the stringers in plastic pallets made in accordance with the present invention are configured to provide openings to allow for either two-way fork entry or four-way fork entry, that is entry to the pallet in either direction for lifting and moving the pallet, with a hand truck or forklift. The plastic pallets made in accordance with the present invention are preferably constructed with a joining technology that does not require mechanical fasteners. This may be achieved through use of attachment methods which include the use of adhesives or various forms of welding such as solvent welding, hot plate welding, microwave welding, ultrasonic welding or even laser welding.

The plastic pallets made in accordance with the present invention are preferably constructed of a thermoplastic material that allows the pallet to be reused and/or recycled.

BEST MODES FOR CARRYING OUT INVENTION

Figure 1:
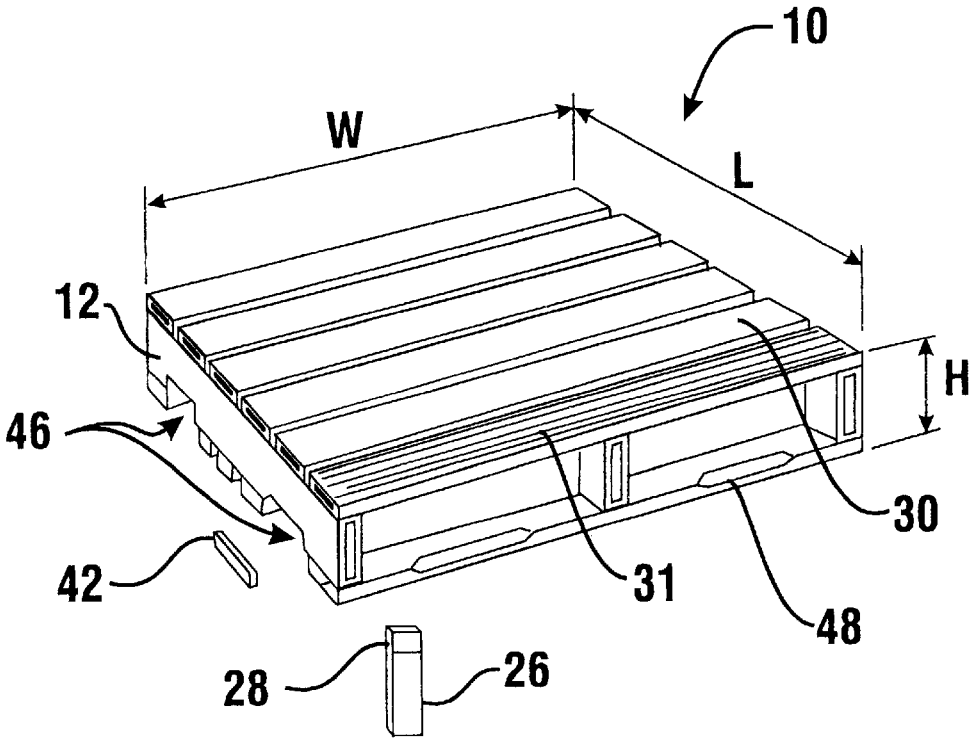
FIG. 1 is an elevated perspective view of a first embodiment of a plastic pallet of the present invention.

Referring to the drawings where like numerals designate like or similar features throughout the several views, and first to FIGS. 1–12, there is shown a plastic pallet generally designated 10 of various designs according to the present invention. Referring back to FIG. 1, there is shown pallet 10 which includes a plurality of longitudinal spaced apart stringers 12 that are situated substantially parallel to each other. Each of the stringers 12 is formed from a thermoplastic material. The term thermoplastic material as employed herein is intended to include any plastic or polymeric material such as polyvinyl chloride (PVC), polystyrene, polyolefins such as polypropylene and polyethylene, cross-linked polyolefins, copolymer resins such as acrylonitrile-butadiene styrene (ABS), acrylonitrile-styrene, polyester resins such as polyethylene terephthalate, post industrial recycled plastics and/or post consumer recycled (PCR) plastics such as recycled high density polyethylene (HDPE) and low density polyethylene (LDPE), and mixtures which would include lesser amounts of polyethylene terephthalate and polypropylene. Other plastics and polymer compounds or polymer blends with similar properties may be used, if desired. Additionally, filled polymers/blends, reinforced polymers/blends, or cellular polymers/blends may be employed in embodiments of the present invention and are intended to be encompassed within the term thermoplastic. In addition, pigments may be added to provide color combinations to suit a particular need or desired color arrangement.

Preferably, stringers 12 are formed by extrusion, but may be formed using any suitable technique such as injection molding, compression molding or blow molding. Stringer 12 has a pair of longitudinal walls 14 best seen in FIG. 13. The walls 14 are connected in cross section by a top wall surface 16 and a bottom wall surface 18. Stringer 12 has an interior area 20 defined by the longitudinal walls 14, and the top and bottom wall surfaces 16, 18.

A plurality of reinforcement ribs 22 extend in the interior area 20 of stringer 12. Reinforcement ribs 22 are situated substantially perpendicular to the longitudinal walls and have smooth radiused corner surfaces where the ribs join with the interior surfaces of walls 14. Ribs 22 preferably extend the length of the stringer and are integrally formed therewith. The ribs are also made from the thermoplastic material which comprises the walls and top and bottom wall surfaces of the stringer. The stringer is preferably manufactured as an extruded profile. The extruded profile of stringer 12 can be lighter in weight than wood or metal.

The reinforcement ribs 22 of stringer 12 divide the interior area 20 of the stringer into compartments. Such compartments in some embodiments are capable of receiving a weighted material such as metal rods, bars, pellets or balls, or even a filler weighted material for example, sand, concrete, etc. The reinforcement ribs 22 may include a groove or a notch or other means (not shown) which facilitate attachment of an end cap 26 thereto. The end cap serves to close off access to the interior area of the stringer and may also provide structural reinforcement of the pallet as later discussed.

For example, a pallet of the configuration shown in FIG. 1 which is approximately 42 inches wide by approximately 52 inches long, includes stringers 12 which preferably have a length of about 52 inches. The longitudinal walls 14 of the stringer are approximately 3.75 inches tall and have a width of approximately 2½ inches across the top 16 and the bottom 18 wall surfaces of the stringer. The top and bottom wall surfaces have a wall thickness that can range from approximately 0.075 inches to approximately 0.160 inches, with about 0.100 inches preferred. The longitudinal walls and reinforcement ribs have a preferred thickness of about 0.100 inches. Of course these dimensions are exemplary and may vary with application and/or design, and the invention is not limited thereto.

Figure 13:
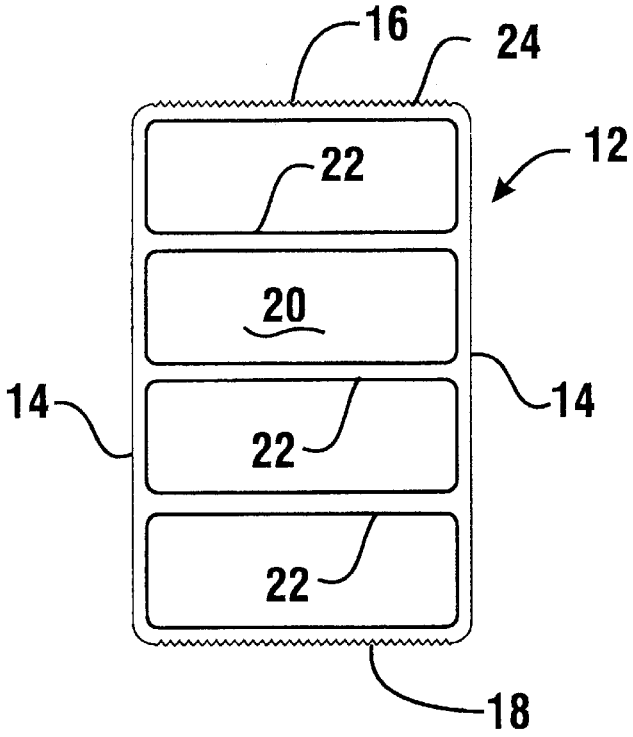
FIG. 13 is a lateral sectional view of a first stringer used in plastic pallets of the present invention.
Figure 16:
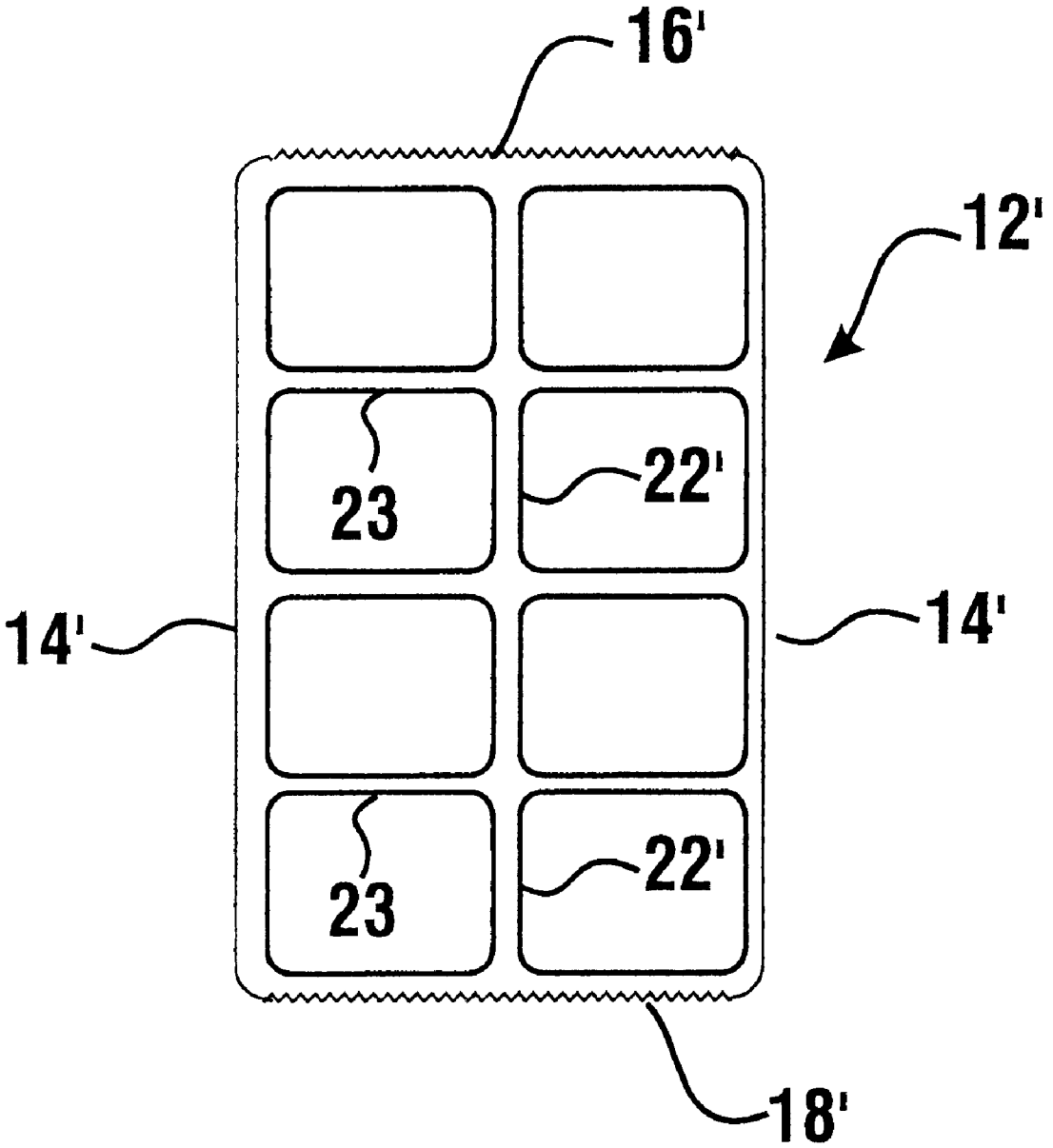
FIG. 16 is a cross sectional view similar to FIG. 13 showing an alternate embodiment of a stringer used in plastic pallets of the present invention.

The alternative embodiment of the stringer 12' shown in FIG. 16 includes a vertical reinforcement rib 22' which extends parallel to the longitudinal walls 14'. The alternative stringer 12' includes a plurality of horizontal ribs 23 which extend between the interior surfaces of the walls 14' and the vertical rib 22'. All of the ribs 22' and 23 preferably include radiused corner surfaces where the ribs join other surfaces as shown in FIGS. 13 and 16. The radiused corners provide added strength and help to prevent cracking. In other embodiments other arrangements of internal ribs may be used, such as multiple vertical ribs.

Figure 19:
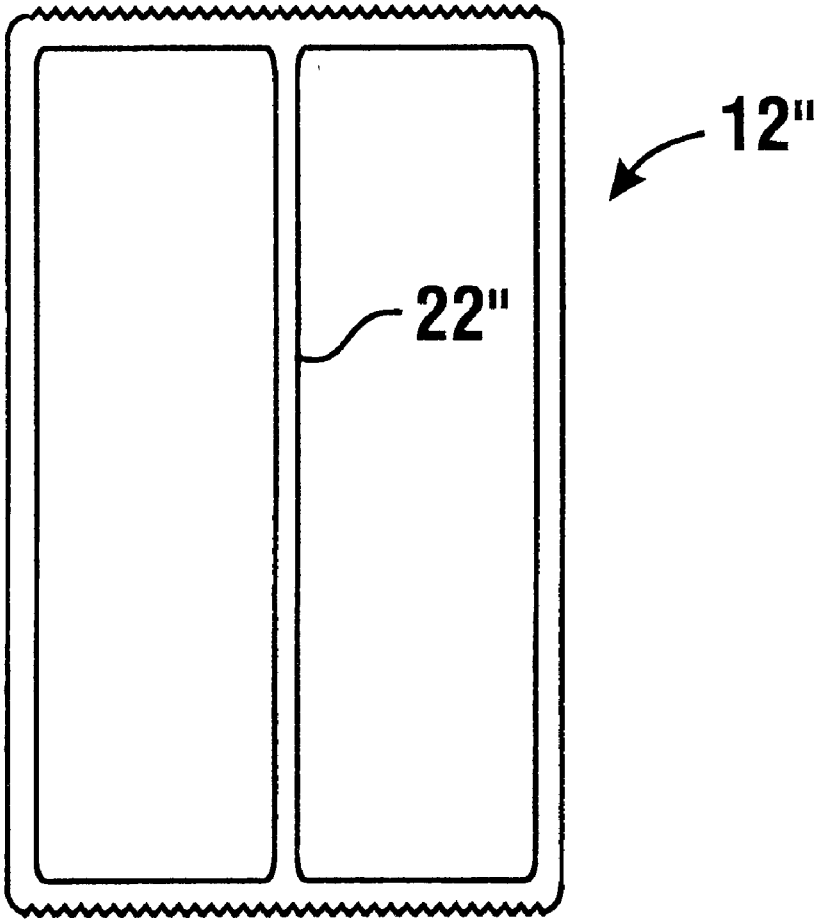
FIG. 19 is a cross sectional view showing an alternative embodiment of a stringer used in pallets of the present invention.

A further alternative form of a stringer 12" is shown in cross section in FIG. 19. Stringer 12" is similar to stringers 12 and 12' except that stringer 12" includes a single internal rib 22". Rib 22" is configured to extend parallel to the side walls. The rib 22" is intended to extend vertically when the pallet is in its load bearing condition. Rib 22" includes radiused corner surfaces where it joins with the interior surfaces of the stringer 12". Rib 22" may operate as an internal load bearing member in a manner comparable to an "I-beam". Alternative embodiments may include multiple vertical ribs and combinations of horizontal and/or vertical ribs.

It should be understood that the cross sectional configurations of the stringers and deck boards discussed are exemplary and that other arrangements of internal supporting structures may be used. Such structures may include angled supports or "x-shaped" supports in the interior area. It should further be understood that the references to vertical and horizontal structures on or in connection with pallets of the invention or components thereof are used for convenience only and to facilitate referring to orientations of features of the described embodiments in a load bearing position. Such descriptions shall not be deemed to limit the scope of the claimed invention.

The external surfaces of stringers may have various forms. In some embodiments the stringers may have side walls and top and bottom walls with generally smooth exterior surfaces. Alternatively, one or more exterior surfaces of the stringers may include a plurality of elongated ridges 24, such as is shown on the top 16 and bottom 18 of the stringer 12 shown in FIG. 13. In the embodiment shown the ridges 24 extend parallel to the side walls of the stringer and are an integral part of the extruded profile. As later discussed, the ridges may facilitate the processes used for attaching the stringers to other components of pallets. In addition, ridges may act to provide mechanical interlocking and enhanced frictional engagement with features on adjacent parts or surfaces. This may include surfaces which are joined to the stringers in the manufacture of the pallet, surfaces of a load carried on the pallet or surfaces of a moving or lifting mechanism used to move or lift the pallet. The ridges 24 shown on the stringers and other pallet components are exemplary and it should be understood that other types of structures may be used in embodiments of the invention for enhancing temporary or permanent engagement of pallet surfaces with other surfaces.

In some preferred embodiments, stringers 12, 12' or 12" may include an end cap 26 mounted thereon. End cap 26 is preferably constructed of a tough thermoplastic material similar to that of stringer 12. End cap 26 is preferably constructed to fit snugly on or within an open end of the stringer to close access to the interior area thereof.

End caps may include an identifying means 28 such as a bar code, processor chip, label, indicia, or the like, which provides information such as identifying information concerning the pallet, the load carried thereon, or both. Alternative forms of end caps may include a compartment in its interior area for holding paperwork or a computer memory chip. Alternatively, end caps may be made removable so that devices or materials may be stored in the interior area of the stringers. The snugly fitting end caps on the stringers preferably seal the interior area 20 from dirt, moisture, insects, fungus, mold and bacteria. When pallet 10 is employed to support food products, medical items, or pharmaceuticals, the end caps on the stringers provide for a more hygienic, washable, sanitizable pallet.

The end caps used in embodiments of the invention may take various forms. For example, some end caps may be rectangular closure members which close the open ends of stringers. Other end caps may include attaching members for attaching to internal ribs or wall structures of the stringer. Such features may be used to enhance the engagement of the end cap with the stringer or to achieve a structure which provides selectively releasible engagement of the end cap and the stringer.

Figure 21:
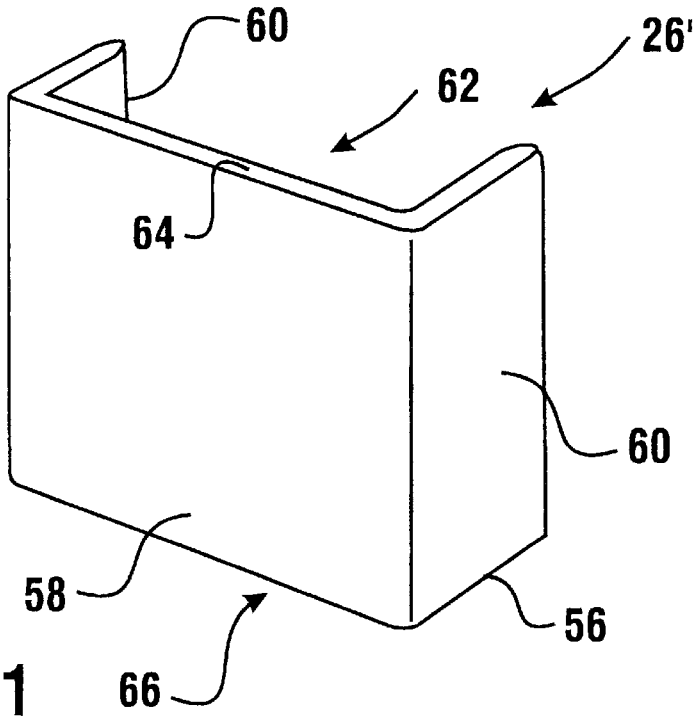
FIG. 21 is an isometric view of a first form of an end cap used in connection with stringers used with pallets of the present invention.

While in some embodiments the end caps may contribute little to the structural integrity of the pallet, in other embodiments end caps may provide greater protective and reinforcement capabilities. An example of an end cap which includes such capabilities is indicated 26' and is shown in FIG. 21. End cap 26' includes a body 56. Body 56 includes an outer plate portion 58 and a pair of projecting portions 60. The projecting portions bound a recess 62. The end cap 26' further includes a first surface 64 which extends across one side of the outer plate portion and the projecting portions. A second surface 66 extends on an opposed side of the end cap from first surface 64.

Figure 23:
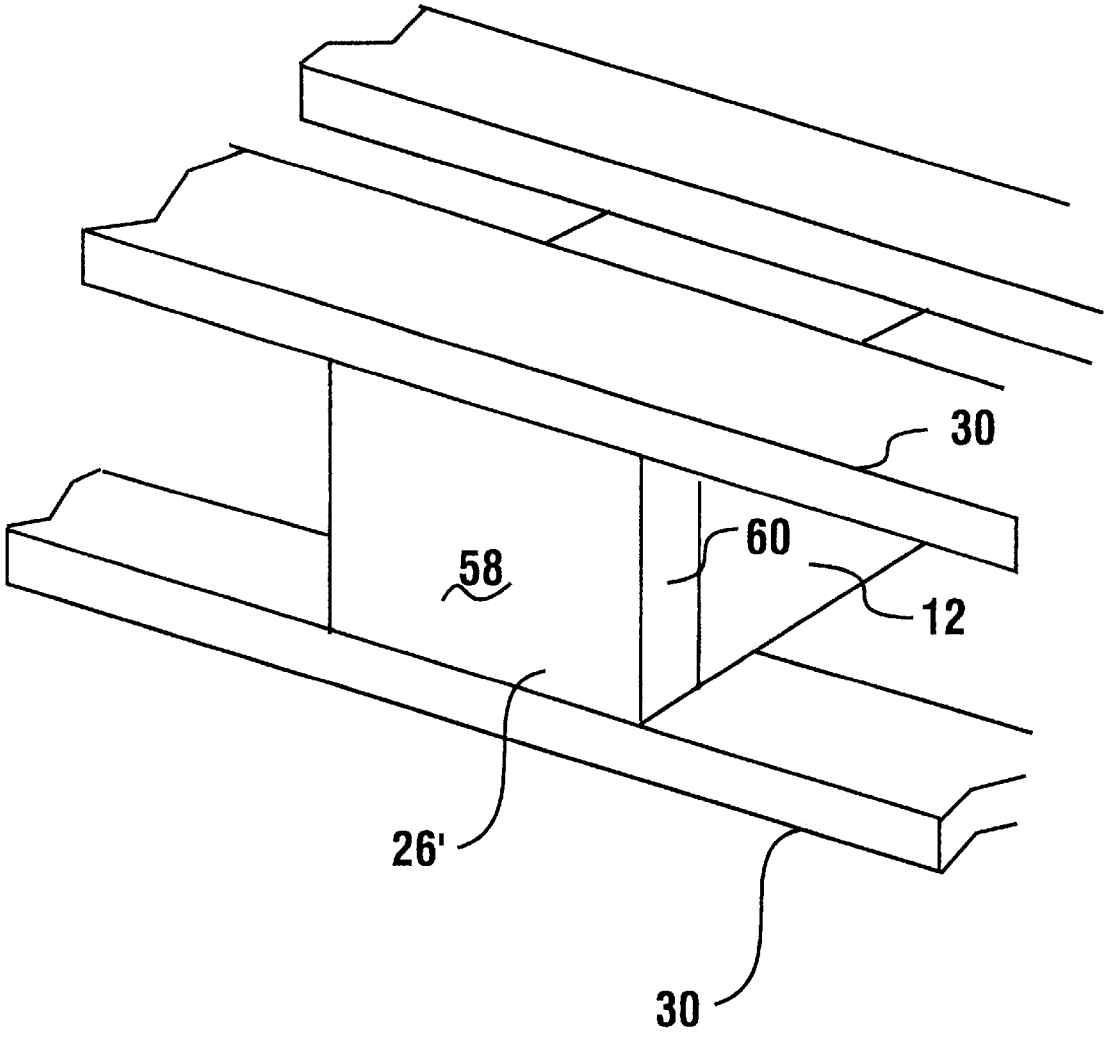
FIG. 23 is an isometric view of a portion of a pallet with the end cap shown in FIG. 21 included thereon.

As shown in FIG. 23, in the construction of a pallet of the invention using end cap 26', the end cap is positioned on the end of a stringer 12. The outer plate portion 58 overlies the end of the stringer to close access to the interior area. The projecting portions 60 overlie the side walls of the stringer 12 and are fixably attached thereto. The stringer extends in the recess 62 between the projecting portions 60, and the projecting portions extend on the outside of the side walls a substantial distance. The projecting portions are adhered to the adjacent stringer walls for substantially the entire length of the projecting portions, or are otherwise fixed in engagement thereto. This provides enhanced strength for the stringer in the area adjacent the end where forces associated with the forks of lift and hand trucks are often applied. The projections on the end cap also help protect the walls of the stringer from being broken or torn by the forks of lifting devices. Such damage can cause cracking or tears which can propagate and may eventually render the pallet unusable. In one form of the end cap 26' the projecting portions extend about one inch from the end of the stringer. Other embodiments may have projecting portions of other dimensions depending on the materials being used and the nature of service for which the pallet is intended.

As shown in FIG. 23 the pallet may be constructed so that deck boards 30 or other members which extend on opposed sides of the stringer 12 overlie the first and second surfaces 64, 66 of the end cap. Preferably, surfaces 64, 66 are attached to the adjacent deck board by a fastening technique which provides generally continuous engagement between the surfaces of the end cap and the adjacent deck board. This generally continuous engagement which is like that between the projecting portions 60 and the stringer 12, creates an assembly which holds the parts in fixed engaged relation at the stringer ends. This fixed engagement provides for transmission and dispersion of applied forces in the area of the end cap which aids in preventing separation or breakage of the pallet components. This construction resists tensile and compressive forces as well as torsional forces. This ability of the assembly to hold together and resist higher forces increases durability and generally prolongs the useful life of the pallet.

Figure 22:
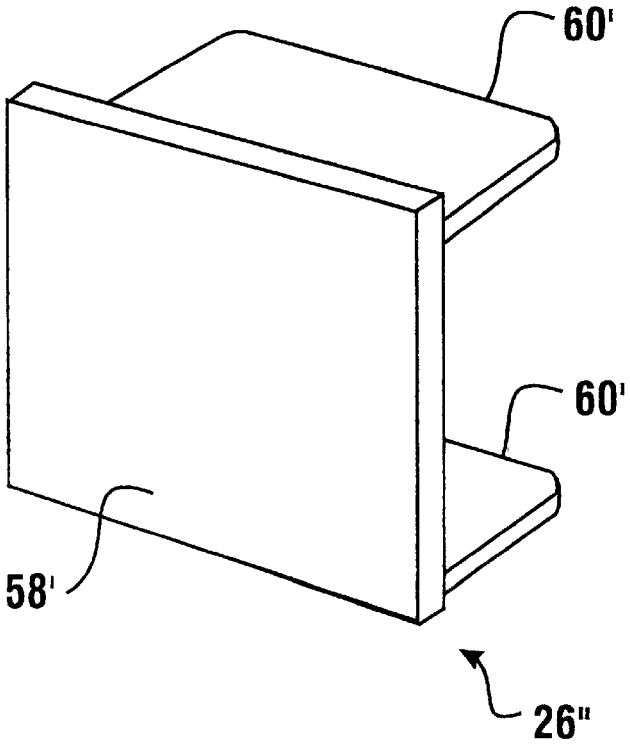
FIG. 22 is an isometric view of an alternative end cap for a stringer.

An alternative embodiment of an end cap 26" is shown in FIG. 22. End cap 26" includes projecting portions 60' which extend from a plate portion 58'. Projecting portions 60' are sized and positioned to extend in the interior area of a stringer and engage inside surfaces of the walls or surfaces of the stringer. As in the case of end cap 26', the projecting portions 60' are engaged with the surfaces of the stringer a substantial distance to enhance strength and minimize deflection and damage. Surfaces bounding plate portion 58' may also be engaged with adjacent stringers to achieve more solid engagement of all adjacent parts, the advantages of which have been previously discussed in connection with end cap 26'.

Alternative embodiments of the invention may include end caps with projecting portions that extend both inside and outside of the stringers. This may provide added strength and damage resistance. Alternative forms of end caps may further include features such as internal or external reinforcing ribs to increase load bearing capability or to provide increased abrasion resistance. For example enlarged or thickened areas may be provided in areas that are positioned in locations likely to be subject to contact and abrasion by lifting forks. Surfaces of the end cap may also include ridges or other structural features to facilitate engagement to adjacent surfaces and/or to increase frictional or mechanical interlocking engagement with adjacent surfaces.

Returning to FIG. 1, the embodiment of the pallet shown therein includes a plurality of deck boards 30 that extend generally longitudinally and parallel to one another. The deck boards 30 are spaced apart as shown, and are positioned transversely in supporting connection with the stringers 12. These deck boards which are positioned above the stringers when the pallet is in its usual load bearing orientation are also referred to as top deck boards. Preferably, deck boards 30 are situated substantially parallel on the stringers and are in alignment with the outward ends of stringers 12, or the outer surface of an end cap, when the deck boards extend adjacent to a stringer with an end cap thereon.

Deck boards 30 may also be positioned transversely underneath stringers 12 when the pallet in is a load bearing orientation. Such deck boards extend in a substantially parallel and like orientation to the top deck boards (deck boards 30 below the stringers are also referred to herein as bottom deck boards). Alternately, deck boards 30 may be adjacent the ends of stringers 12 but may extend a distance outward therefrom such as in pallets of the type shown in FIGS. 4 and 6.

Deck boards 30 like stringers 12, are preferably made from thermoplastic material as previously described herein. However in some embodiments of pallets of the invention the deck boards may be fabricated from a different type of thermoplastic material than that used in the stringers. For example, one material may be used to achieve relatively greater rigidity of the stringers and another material may be used for toughness, resilience or flexibility of the deck boards, or vice versa. Preferably, deck boards 30 are manufactured as extruded profiles like stringers 12, but alternatively like stringers 12, may be formed by injection molding, compression molding, thermo forming, blow molding or other suitable processes.

Figure 14:
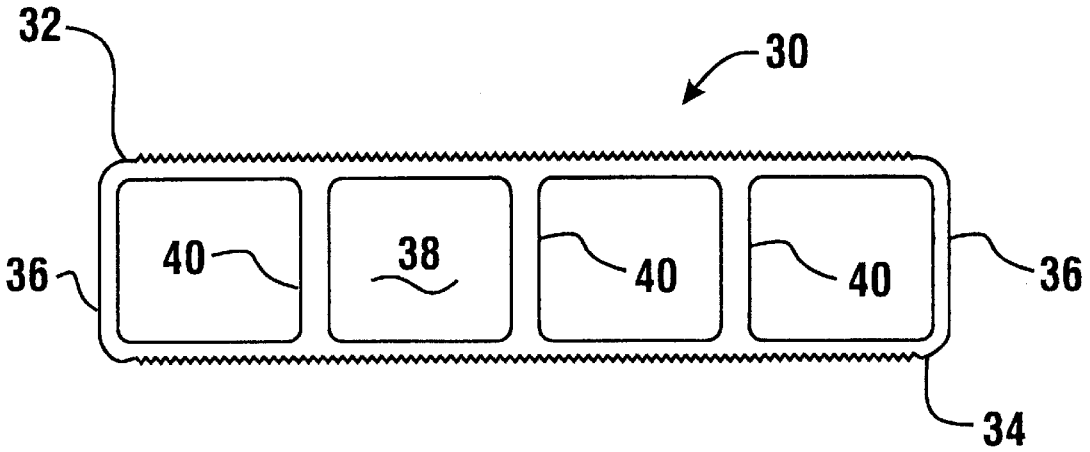
FIG. 14 is a lateral sectional view of an embodiment of a deck board used in plastic pallets of the present invention.

As best shown in FIG. 14, each of the deck boards 30 of the described embodiment in cross section has an upper side 32 and a lower side 34 connected by side walls 36. Together the upper side 32, lower side 34, and side walls 36 define an interior area or cavity 38. A plurality of reinforcement ribs 40 having radiused corner surfaces are preferably vertically situated in the interior area 38. Ribs 40 extend substantially perpendicular to the upper and lower sides 32, 34 and are integrally formed therewith. Reinforcement ribs 40 preferably extend the length of the deck board 30. The ends of the deck boards are preferably closed by end caps 42. Ribs 40 may include a groove or notch (not shown) for optionally receiving or releasibly engaging an end cap 42. The end cap preferably includes projections that are inserted into the ends of deck board 30. The end caps may alternately be constructed to slide over the end of the deck board 30. The end caps may be constructed to carry and distribute loads to adjacent stringers in a manner similar to the end caps used in connection with certain stringers, or alternatively may be generally non load bearing closure members, depending on the nature of the pallet.

The end cap 42 may be constructed of a thermoplastic material like the end caps 26, stringers, and deck boards previously described. Of course, it should be immediately apparent that deck boards 30 and stringers 12 and even the end caps may each be formed from different thermoplastic materials as previously described herein. In some embodiments the end caps 42 may be permanently attached to the deck boards. Alternatively, some end caps 42 may be made removable from the deck boards. Removable end caps 42 may include compartments for storage or identifying means 28 such as a bar code, processor chip, label, indicia or the like, or may provide for selectively accessing compartments or items housed in the interior areas of the deck boards.

The reinforcement ribs 40 divide the interior area 38 of deck board 30 into compartments. The compartments in some embodiments may be capable of receiving a weighted material for adding weight to the pallet or for receiving supporting material for providing additional support when the pallet 10 receives heavier loads. The weighted and/or supporting material includes but is not limited to metal bars or rods or weighted pellets or balls of steel or lead, or even a filler material such as sand, concrete, or the like. Alternatively cavities may be filled with materials which perform other functions. For example cavities of deck boards and/or stringers may include materials or devices which serve as a heat source or heat sink. Other materials designed to react with materials carried on the pallet may be included. This may include for example a fire extinguishing agent or sorbent material. Alternatively the interior areas of the pallet components may include radio, light or other types of transmission or receiving devices to facilitate locating and tracking the pallets or the materials supported thereon.

Figure 15:
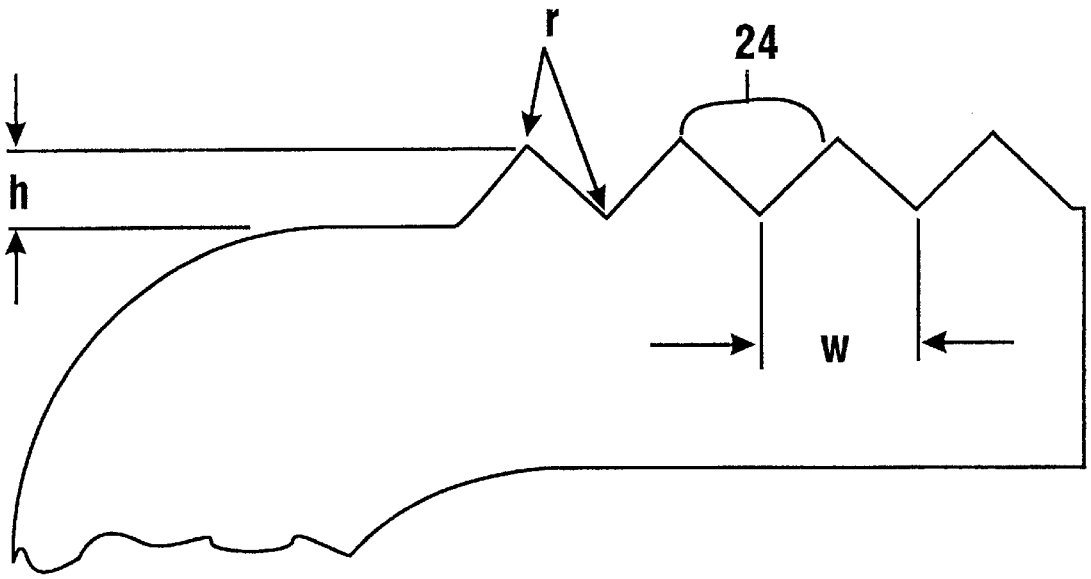
FIG. 15 is a closeup cross sectional view of a portion of the ridges on a surface of the deck boards shown in FIG. 14 depicting the ridge profile.

In one exemplary embodiment, each of the deck boards 30 includes a plurality of ridges 24 on outer surfaces thereof as shown in FIG. 15. Preferably, for an exemplary pallet 10 having a dimension of approximately 42 inches in width (W) by approximately 52 inches in length (L), a deck board 30 would be about 42 inches long, range from about 3.5 to 5.5 inches wide with a preferred width of about 4.5 inches, and approximately one inch high. There may be approximately seventy ridges 24 on each side 32, 34. In this example each ridge is preferably about 0.030 inches in height (h) and approximately 0.060 inches wide (w). Each ridge 24 preferably has a radius (r) of approximately 0.003 inches at the apex and between each base as shown in FIG. 15. Of course, the above dimensions are for one exemplary embodiment and the present invention is not intended to be limited to these specific dimensions. For the pallet described in this example the deck boards 30 may have an outer wall thickness ranging from about 0.075 inches to about 0.160 inches, and is preferably approximately 0.125 inches. The rib thickness can range from about 0.075 inch to 0.160 inch, and is preferably approximately 0.100 inches. It should be understood that ridges 24 may take on other shapes, for example, a more rounded, wave-like, or sinusoidal shape. Alternatively, in other embodiments the ridge surface of the deck board may be dimpled or roughened.

The ridges across the deck boards of this exemplary embodiment act to increase friction to resist movement of items supported thereon along the boards. A wide spacing of the ridges can improve toughness. Still another alternative to achieve increased friction is to coextrude a layer of high coefficient of friction material as a layer which comprises small irregular ridges on the deck boards.

Alternative forms of ridges which provide for enhanced frictional engagement between deck boards and loads carried on the deck boards may be provided. Alternatively or in addition, ridges or other friction enhancing features may be provided to enhance engagement between deck boards and the lifting forks or other structures that engage the pallet for lifting or transport. Such ridge structures on outer deck board surfaces also provide for mechanical interlocking between deck boards on adjacent pallets which act to restrict movement when pallets are stacked for storage or shipment. It should be understood that ridges as used in connection with plastic pallets of the invention may include various sized regular or irregular protections or depressions, dimples, non-slip members, high friction or resilient coatings or other features which achieve enhanced engagement between adjacent surfaces.

Figure 24:
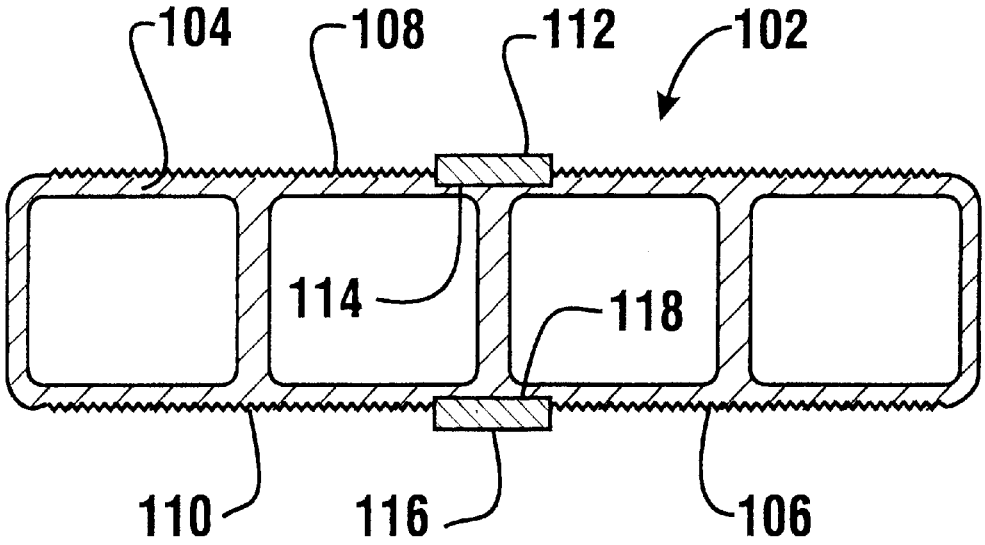
FIG. 24 is a cross sectional view similar to FIG. 14 showing an alternative deck board used in embodiments of pallets of the present invention.

An alternative deck board 102 is shown in cross section in FIG. 24. Deck board 102 has an upper side 104 and a lower side 106. Board upper side 104 is bounded by an upper face 108. Upper face 108 includes ridges thereon. Board lower side 106 includes a lower face 110 which also includes ridges thereon.

An upper strip 112 extends on board upper side 108. Strip 112 extends in a recess 114 in the embodiment shown and extends upward in the load bearing orientation of the pallet beyond the upper face 108. The upper strip 112 in this exemplary embodiment is comprised of a material that is not as hard as the material of the surrounding deck board 102. This may include for example a strip material such as semi-rigid PVC. The upper strip 112 also preferably extends above the upper face 108 by generally about 0.002" to 0.005". This facilitates engagement of the pallet with loads supported thereon.

A lower strip 116 is supported on the lower board side 106 of the deck board 102. Lower strip 116 in the embodiment shown extends in a recess 118. Lower strip 116 is also comprised of a material having a lower hardness than the surrounding material of the deck board 102. The lower strip 116 also preferably extends downward below the lower face 110 of the deck board in the operative position of the pallet by about 0.002" to 0.005".

In embodiments of the invention the deck boards may have upper strips and not lower strips, and vice versa. Some deck boards of a pallet may have no strips while others have upper or lower strips. In addition deck boards may have multiple strips supported on a side. Some deck boards may not include surfaces with ridges. The strips employed in embodiments of the invention may be formed or applied in a variety of ways. For example, the strips may be coextruded with the deck boards. Alternatively, the strips may be fixed to the deck boards with an adhesive or other suitable holding material. The strips may be a resilient material or other material suitable for achieving increased resistance to slippage.

It should be understood that strips 112, 116 are exemplary forms of non-slip members that may be attached to deck boards (and stringers or other members) in embodiments of pallets of the invention, to reduce slippage. Other non-slip members may have shapes other than strips and may be continuous or non-continuous relative to the pallet member on which they are positioned. A variety of attachment techniques for attaching non-slip members may be used.

Figure 25:
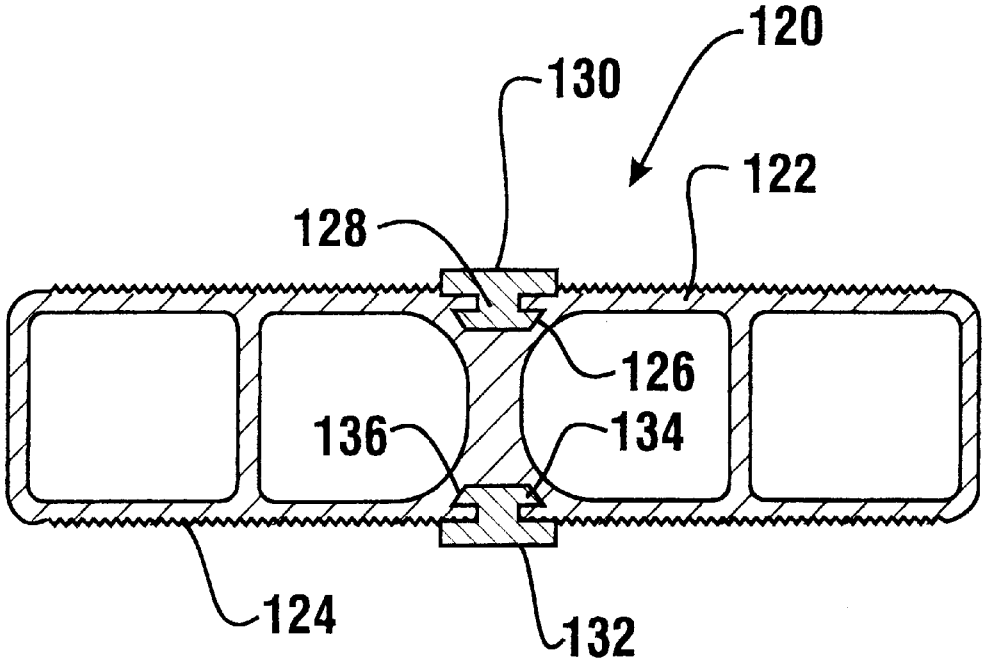
FIG. 25 is a cross sectional view similar to FIG. 24 of yet another alternative deck board used in embodiments of pallets of the present invention.

FIG. 25 shows another exemplary deck board 120 used in embodiments of pallets of the invention. Deck board 120 includes an upper side 122 and a lower size 124. Upper side 122 includes a recess 126. Recess 126 is configured for releasible locking engagement with a projecting portion 128 of a friction strip 130. Strip 130 is preferably a material with an outer surface suitable for providing increased frictional engagement and is a material that is less hard than the material of the deck board 120. The outer surface of strip 130 also preferably extends beyond the upper face bounding the deck board. In the embodiment shown deck board 120 also has a lower strip 132. Strip 130 includes a projecting portion 134 which is releasible lockably engageable in a recess 136.

Deck board 120 is an example of a deck board which includes a non-slip member that can be readily replaced. For example, if strips 130, 132 or portions thereof are worn or broken, the damaged portion may be removed and a new portion installed by engaging the new portion in the recess. It should be understood that the locking configuration shown for the strips and the recesses is exemplary and numerous other configurations may be used. Also non-slip members may be used on only one side of the deck board and may be continuous or non-continuous relative to the deck board. Alternative configurations for non-slip members and methods for attachments to members which comprise pallets of the invention will be apparent to those skilled in the art from the foregoing description.

The ridges such as ridges 24 on the embodiment of the deck boards shown in FIGS. 14, 24 and 25 may not only function to reduce slippage, but they may also act as energy concentrators for welding operations. Such ridges may also provide adhesive thickness control, when adhering adjacent components of the pallet with adhesives. Embodiments of the stringers 12 may also include ridges 24 on the top 16 and/or bottom 18 surfaces. Such ridges may provide energy concentration for welding or adhesive thickness control and containment to enhance adherence to adjacent pallet components. As previously mentioned, surfaces of the stringers may also include ridges to achieve increased frictional or mechanical interlocking engagement with adjacent surfaces.

In pallets of the invention deck boards may be joined to the stringers by either a structural adhesive or thermoplastic welding. The term adhesive as used herein is meant to include cements, glues, and pastes. The welding of the deck boards to the stringers may alternatively be done using a process which includes but is not limited to, solvent welding (the term solvent welding as used herein is meant to include any solvent capable of liquefying the thermoplastic material to a point where it fuses or joins together as the solvent evaporates), hot plate welding, microwave welding, ultrasonic welding or even laser welding.

Advantageously, the plastic pallets made in accordance with the teachings of the present invention employ no mechanical fasteners. The lack of such fasteners provides an advantage in that points where mechanical fasteners are attached to prior art pallets are potential tear points in the construction of the pallet. The attaching means used in preferred embodiments of the invention minimize such local areas of high stress by spreading forces acting between adjacent parts over relatively larger areas such that the forces acting at any point tend to remain below a threshold for breakage or tearing of the connected members. To achieve this result the joining technique or adhesive should provide a bond at joining locations at least as strong as the pallet materials. Many suitable adhesives for joining thermoplastic materials may be employed with the present invention and these include but are not limited to epoxy adhesives, hot melt adhesives, curable polyurethanes, curable methacrylates, two-component urethane based adhesives, ethylene-acrylic elastomer mixture with PVC and filler, various styrenic block copolymer based hot melt adhesives like styrene-butadiene-styrene (SBS)-based copolymers, styrene-isoprene-styrene (SIS) based copolymers, styrene-ethylene/butyrene-styrene (SEBS) based copolymers, thermosetting resin adhesives, polyamide based hot melt adhesives, polyester based hot melt adhesives, polyether-polyester and polyamide segmented copolymers, polyamide/polyester resins, thermoplastic resin-type adhesives such as blending post-chlorinated polyethylene and polyvinyl chloride, butadiene-acrylonitrile alternating copolymer solution-type adhesive, an adhesive formulation prepared by polymerization of an alkoxystyrene with an olefinically unsaturated nitrile as taught in U.S. Pat. No. 3,846,511 for a hot melt adhesive or solvent cement, unfilled two-component polyurethane adhesives, thermoplastic hot-melt adhesive based on a polymer blend of olefins as described in U.S. Pat. No. 5,512,625, PVC solvent cements using methylethylketone (MEK), dimethyl formamide, tetrahydrofuran, cyclohexanone, methylene chloride, or mixtures thereof, and solvent cements as listed in ASTM D-2235, ASTM D-2564 and/or ASTM D-2369.

Figure 20:
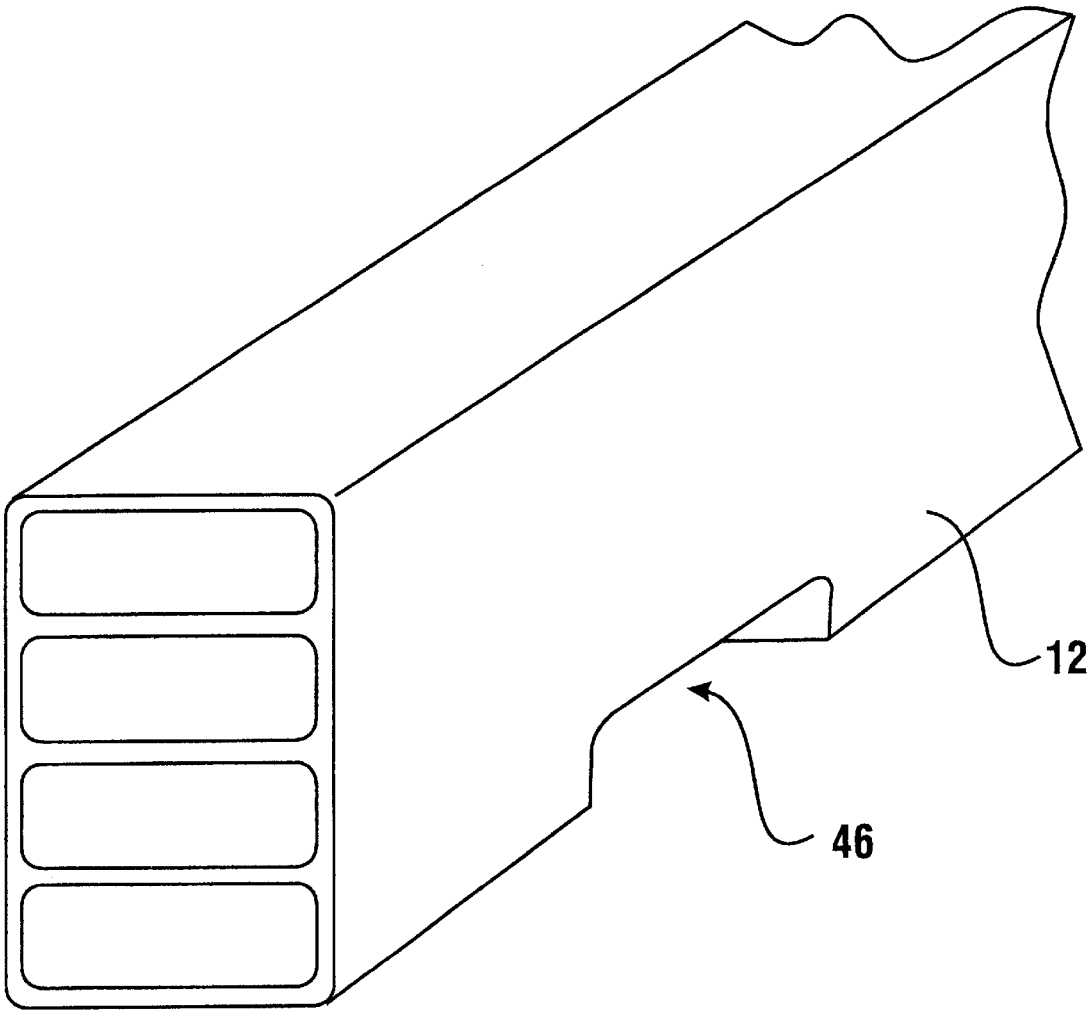
FIG. 20 is an isometric view of an alternative stringer used in pallets of the present invention.

Returning again to FIG. 1, plastic pallet 10 is shown therein assembled and constructed in accordance with the present invention. While the lead deck board 31 shows ridges 24 on its exposed upper surface, it should be understood that some or all of the deck boards (both top and bottom) may include forms of ridges 24 as described herein. As one example, a lead deck board 31 and a last deck board 30 may include ridges 24 on the exposed surfaces facing outward from the pallet while the others do not. Alternatively, outward facing surfaces of all of the deck boards can have ridges 24 to minimize slippage of material supported on pallet 10 or provide the other advantages described previously. In addition inward facing surfaces of deck boards and stringers may include forms of ridges to minimize slippage when such surfaces are engaged with the forks of lift and hand trucks. Additionally, as shown in FIG. 20 alternative forms of stringers 12, 12', 12" may include apertures, openings, indentations or notches 46. As can be appreciated from FIG. 1, notches 46 are adapted for receiving tines or forks from a forklift or similar lifting device. This enables producing pallets allowing for either two-way or four-way fork entry, that is, lifting the pallet 10 from any one of its sides.

Figure 17:
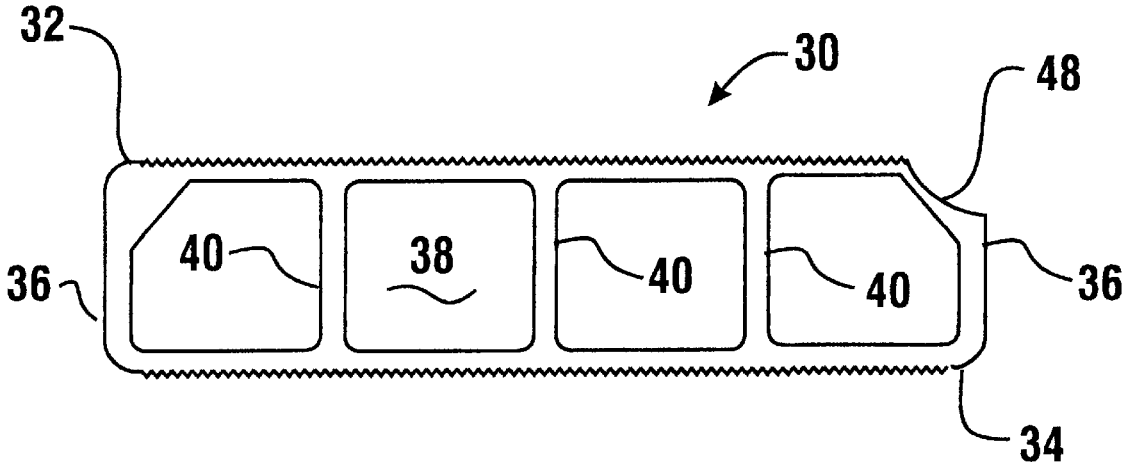
FIG. 17 is a cross sectional view similar to FIG. 14 showing an alternate embodiment of a deck board used in plastic pallets of the present invention.

In embodiments of the invention the bottom deck boards 30 which are positioned on the bottom of the pallet may include contoured surfaces which are referred to as chamfers 48. The chamfers 48 facilitate entry of the forks of the forklift as well as passage of wheels of a hand truck over the lower deck boards. The chamfers 48 are preferably located on the upper side of the bottom deck board shown in FIG. 1, but also could be located on the lower side of the top deck board 31. This would be particularly desirable for a reversible pallet construction. FIG. 17 shows a sectional view of a deck board with a chamfer 48 which is formed with a router or other suitable means, in a deck board 30 at desired locations along its length. Since chamfer 48 is machined into a solid area of the deck board, this embodiment of deck board 30 includes a thicker, solid profile at the corners of the board as seen in FIG. 17.

Figure 18:
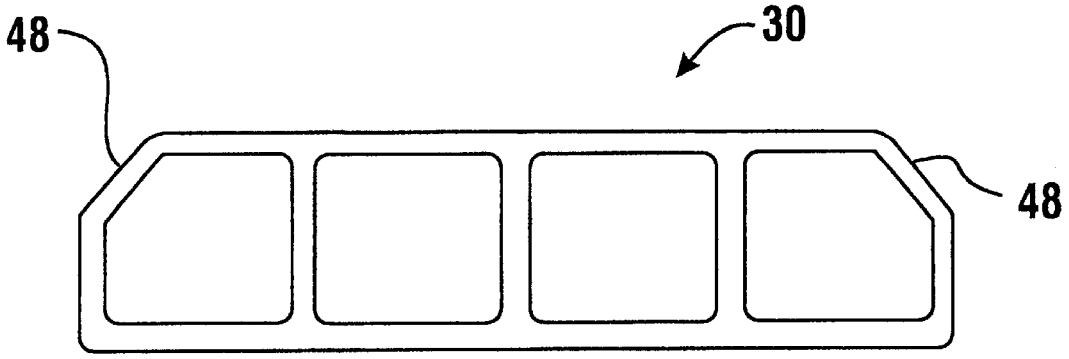
FIG. 18 is a view similar to FIG. 17 showing another alternative embodiment of a deck board used in pallets of the present invention.

FIG. 18 shows an alternative form of a lower deck board 30. This alternative form includes chamfers 48 at both cross sectional sides of the surface facing toward the interior area of the pallet. The contour of the chamfers facilitates movement of the wheels that support the forks of a hand truck in both directions on the deck board. It should be understood that the contours and method of forming the chamferred areas is exemplary and that in other embodiments alternative constructions and methods may be used. It should be understood that the deck boards shown in FIGS. 17 and 18 may also incorporate non-slip members as previously described.

A desirable feature of the present invention is the flexibility it offers in producing a variety of pallet configurations. The two basic members used in producing the described present invention, i.e., stringers and deck boards, enable production of a wide variety of pallet examples of which are shown in FIGS. 1 through 12. FIG. 1 is one form of pallet design which runs the full length of the pallet.

Figure 2:
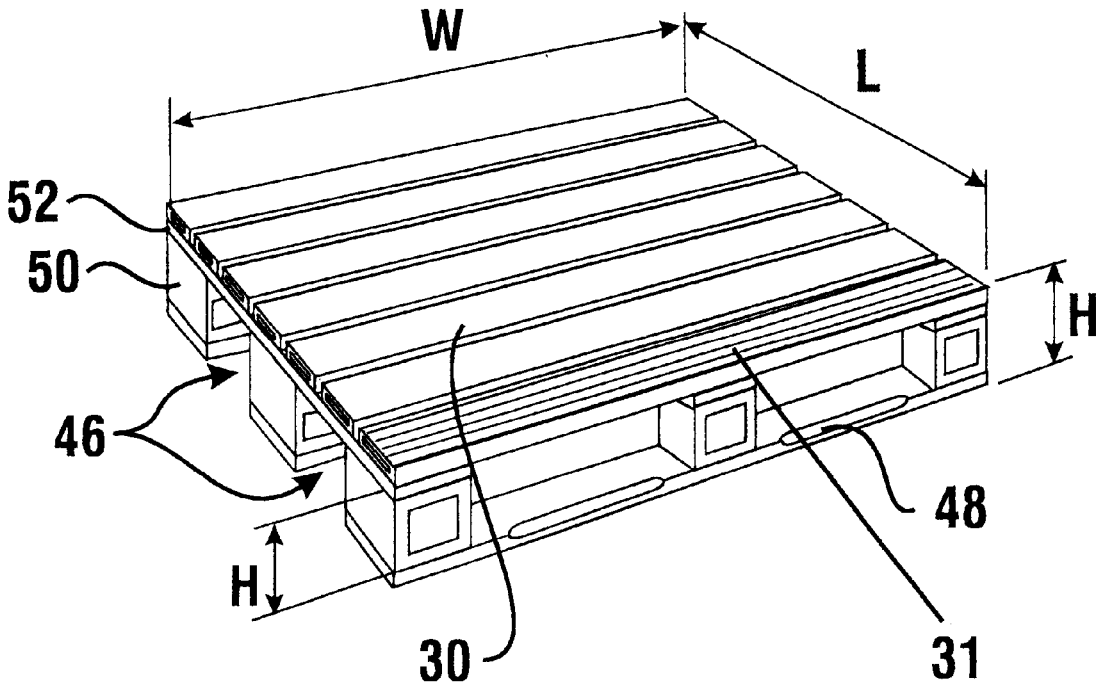
FIG. 2 is a view similar to FIG. 1 of an alternate embodiment of a plastic pallet of the present invention.

As shown in FIG. 2, the stringers 12 of the pallets of the invention may comprise predetermined sections or blocks 50 of the stringers which are spaced apart at a selected distance. The blocks 50 are sandwiched longitudinally between a top and optional bottom (shown in FIG. 3) thermoplastic stringer board 52. Stringer board 52 may be constructed similar to deck board 30, but preferably has a width similar to the stringer.

Figure 3:
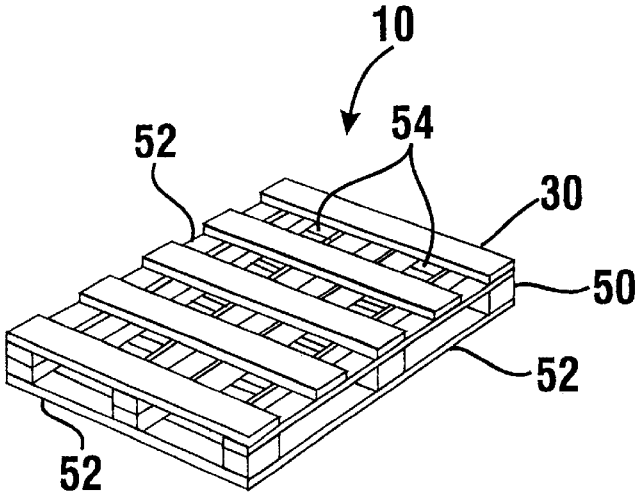
FIG. 3 is a view similar to FIG. 2 of an alternate embodiment of a plastic pallet of the present invention.

FIG. 3 shows an example of a perimeter base block pallet design. This design employs stringer boards 52 around the perimeter of the base and a stringer board 52 across the middle of the base.

Figure 4:
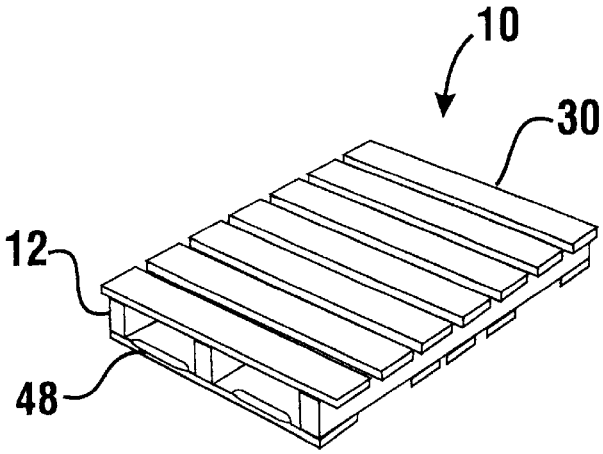
FIG. 4 is a view similar to FIG. 3 of another alternate embodiment of a plastic pallet according to the present invention.

FIG. 4 is a single wing pallet design. The top deck boards 30 extend transversely to and slightly past stringers 12. This design also includes optional chamfers 48 on the upper sides of the bottom deck boards 30.

Figure 5:
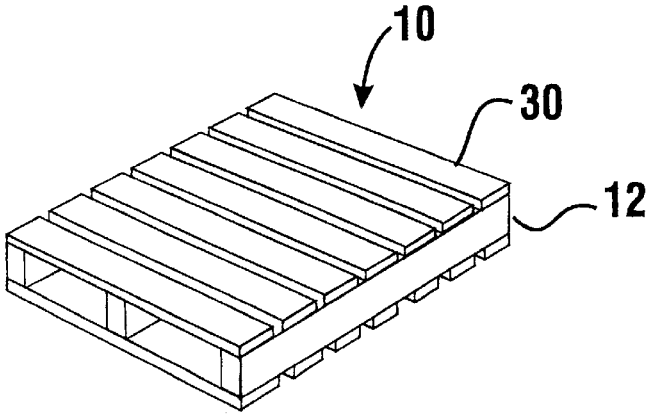
FIG. 5 is a view similar to FIG. 4 of another alternate embodiment of a plastic pallet according to the present invention.

FIG. 5 is a reversible pallet design. This design has a two-way entry for the forks of a fork lift, i.e., front and back.

Figure 6:
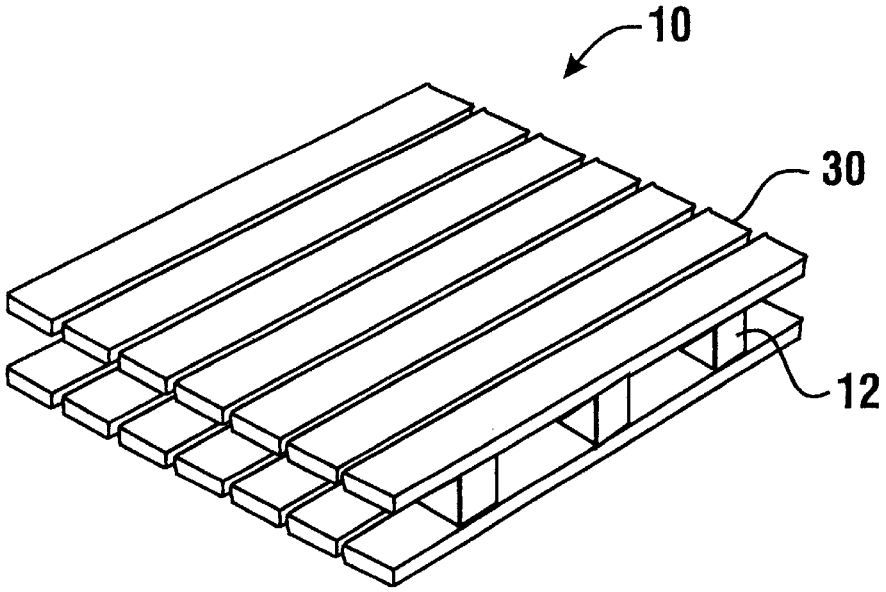
FIG. 6 is a view similar to FIG. 5 of another alternate embodiment of a plastic pallet in accordance with the present invention.

FIG. 6 is a stevedore type double wing pallet design. In this design, both the top and bottom deck boards 30 extend transversely beyond the stringers 12.

Figure 7:
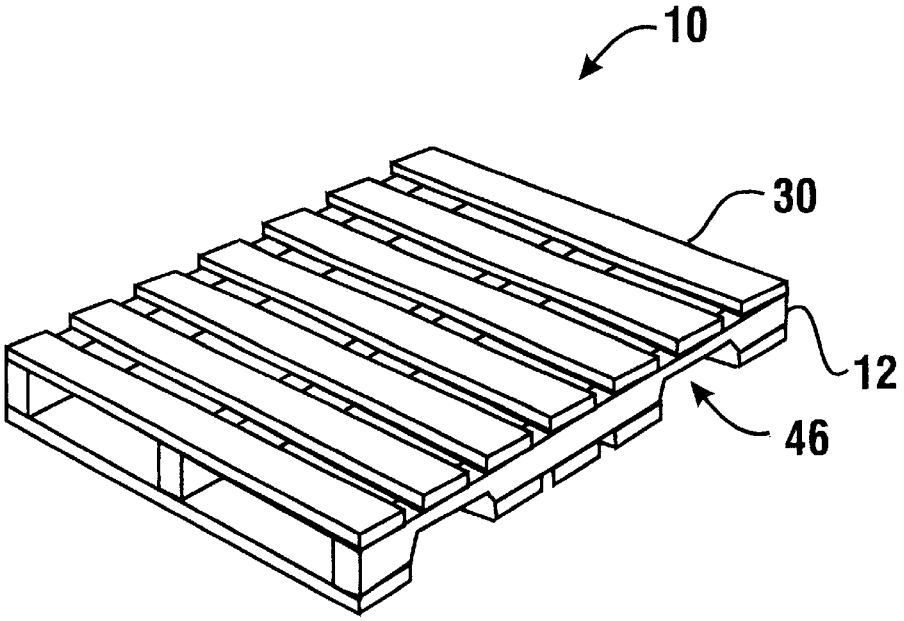
FIG. 7 is a view similar to FIG. 6 of another alternate embodiment of a plastic pallet in accordance with the present invention.

FIG. 7 is an alternative pallet design. This design includes stringers 12 with notches 46 as shown in FIG. 20. This configuration enables four-way entry for the forks in lifting the pallet.

Figure 8:
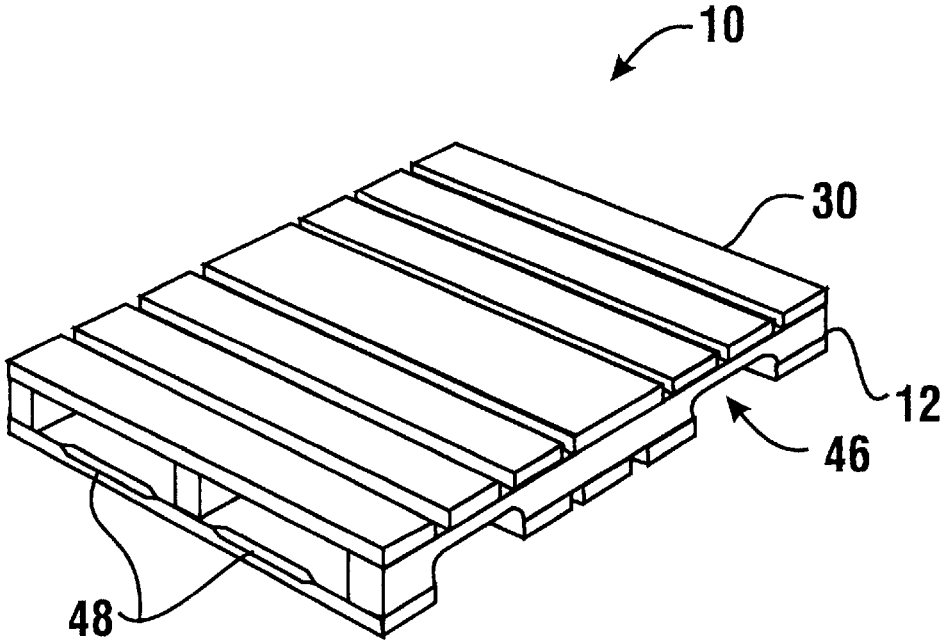
FIG. 8 is a view similar to FIG. 7 of another alternate embodiment of a plastic pallet according to the present invention.

FIG. 8 is a grocery industry pallet design four-way entry pallet made in accordance with the present invention.

Figure 9:
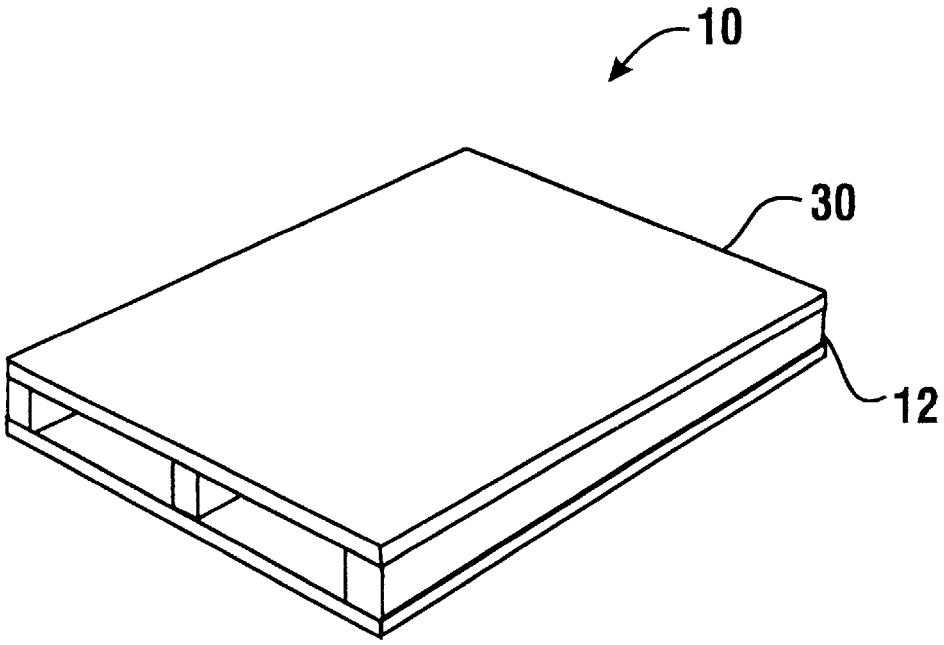
FIG. 9 is a view similar to FIG. 8 of another alternate embodiment of a plastic pallet according to the present invention.

FIG. 9 shows a premium panel deck style stringer pallet. The deck board 30 in the present invention can be manufactured in a wide variety of dimensions including as a panel of thermoplastic material made from one or more pieces.

Figure 10:
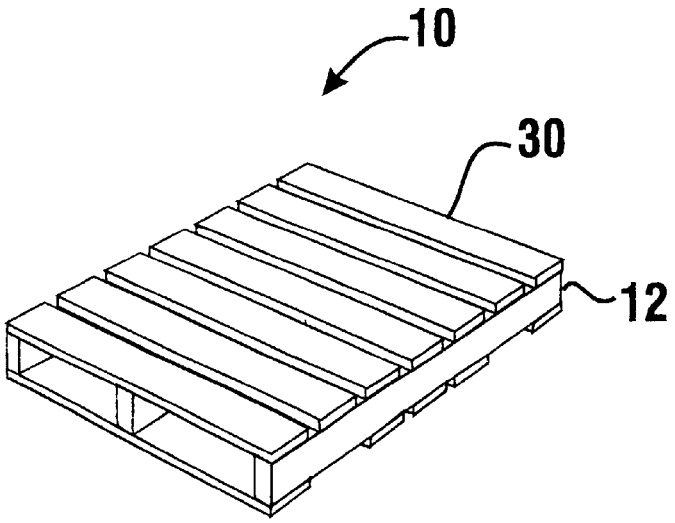
FIG. 10 is a view similar to FIG. 9 of another alternate embodiment of a plastic pallet according to the present invention.

FIG. 10 is a heavy duty two-way stringer pallet design made in accordance with the present invention.

Figure 11:
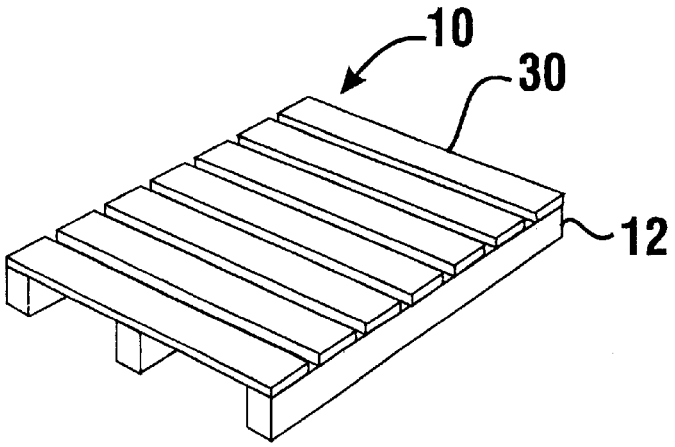
FIG. 11 is a view similar to FIG. 10 of another alternate embodiment of a plastic pallet according to the present invention.

FIG. 11 is a single faced skid pallet design with only top deck boards on the stringers.

Figure 12:
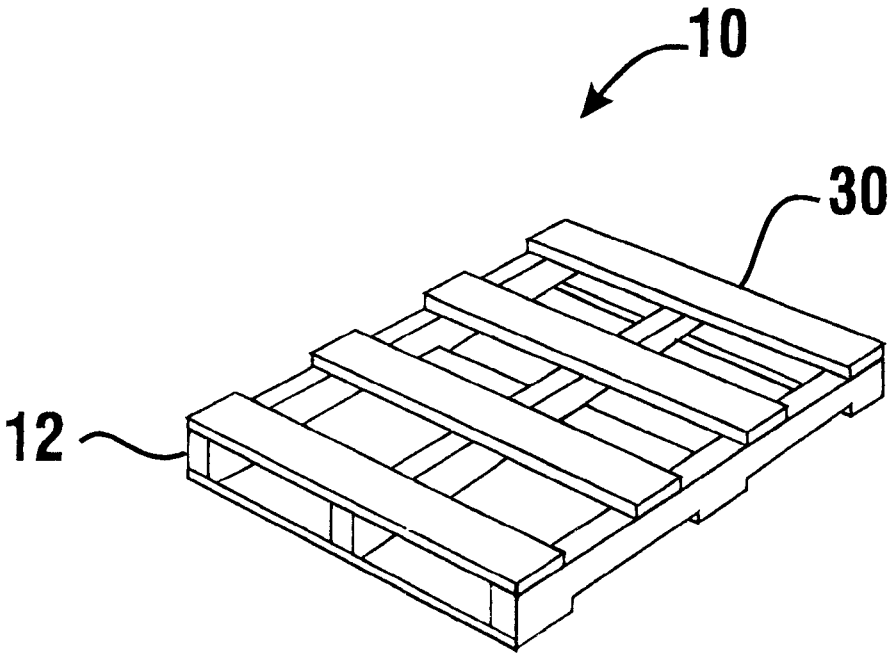
FIG. 12 is a view similar to FIG. 11 of another alternate embodiment of a plastic pallet according to the present invention.

FIG. 12 is a limited use stringer pallet design. It has wide spacing between deck boards 30. Of course pallets of the invention may be made with members of varied sizes and spacing, as well as varied end cap and non-slip member configurations.

As is apparent from the foregoing Figures, the deck boards and stringers can be used in many types of pallet designs and would allow one to customize a certain arrangement for a particular application. Varied types of structures for boards and stringers may be employed. The thermoplastic construction allows for flexibility in the choice of materials, for example, the stringers and boards may be made from the same or different materials. In addition, a pallet component may be made with a high modulus material skin with a foam filled internal cavity or with varied internal support structures.

The stringers and deck boards of certain preferred forms of the present invention are suited or readily adapted for automated assembly. Such a process in an exemplary embodiment would include the steps of extruding or otherwise forming the members which make up the pallet such as the deck boards and stringers. The stringers and deck boards would then be cut to size for a given pallet design. The members would then be positioned (either by robotic or manual methods) so that the stringers and deck boards are in the desired orientation. The stringers and deck boards would then be joined (by robotic or manual methods) by welding, with structural adhesives or other comparable methods. All of the assembly steps for the members may be accomplished using machines which are microprocessor controlled and electronically interconnected to the thermoplastic extrusion process. This may enable the entire process to be automated.

One preferred form of the present invention is a plastic pallet comprised of a polyvinyl chloride (PVC) material that has the ability to be fully recyclable and reusable. Such a plastic pallet construction is also preferably washable and has fewer openings for bacteria, fungi, mold, and insects to collect and grow. The preferred extruded profiles of the members which comprise plastic pallets made in accordance with the present invention are generally less expensive to use and lighter in weight than the prior art wooden or metal pallets. The extruded members which serve as stringers and boards can be made in many profiles and used to make a wide range of pallet types and sizes. Also, the extruded members provide the advantage that they can be cut to any desired length, in line, to minimize scrap.

An additional feature of embodiments of the present invention is to provide shock absorbing means 54 such as blocks of resilient or other shock absorbing material (shown in FIG. 3) between deck boards to function as shock absorbers and improve impact resistance. Bumper strips made from resilient or impact absorbing materials may also be employed on the edge boards and/or stringers. In a similar fashion, the end caps may be covered with shock absorbing material. Such material may have a rounded, semi-circular or other suitable shape for absorbing impacts.

Thus, the plastic pallet and method of manufacture of the present invention achieve the above-stated objectives and eliminates difficulties encountered with the use of the prior art devices and methods, solves problems and attains the desirable results described herein.

In the foregoing description, certain terms have been used for brevity, clarity, and understanding. However, no unnecessary limitations are to be implied therefrom, because such terms are for descriptive purposes and are intended to be broadly construed. Moreover, the descriptions and illustrations herein are by way of examples and the invention is not limited to the detail shown and described. Further, in the following claims any feature that is described as a means for performing a function shall be construed as encompassing any means known to those skilled in the art to be capable of performing that function and shall not be limited to the particular means shown in the foregoing description or mere equivalents thereof.

Having described the features, discoveries and principles of the invention, the manner in which it is constructed and operated, and the advantages and useful results attained, the new and useful structures, devices, elements, arrangements, parts, combinations, systems, equipment, operations and relationships are set forth in the appended claims.

LISTING OF REFERENCE NUMERALS

10 plastic pallet
12 stringers
12' stringer
12" stringer
14 longitudinal walls
14' walls
16 top surface
16' top surface
18 bottom surface
18' bottom surface
20 interior
22 ribs
22' vertical rib
22" rib
23 horizontal ribs
24 ridges
26 removable end cap
26' end cap
26" end cap
28 identifying means
30 deck boards
31 lead deck boards
32 upper side
34 lower side
36 side walls
38 interior area
40 ribs
42 removable end cap
44 ridges
46 apertures or openings
48 chamfers
50 blocks
52 stringer board
54 shock absorber means

56 body
58 outer plate portions
58' plate portions
60 projection portions
60' projecting portions
62 recess
64 first surface
66 second surface
102 deckboard
104 upper board side
106 lower board side
108 upper face
110 lower face
112 upper strip
114 recess
116 lower strip
118 recess
120 deck board
122 upper board side
124 lower board side
126 recess
128 projecting portion
130 strip
132 strip
134 projection portion
136 recess

We claim:

1. A plastic pallet comprising:

a plurality of spaced apart stringers, each of the stringers being formed from thermoplastic material, each of the stringers in cross section having a pair of spaced stringer side walls connected by a stringer top wall and a stringer bottom wall, each of the stringers having a stringer interior area defined by the stringer side walls and the stringer top and bottom walls, each of the stringers further having at least one stringer reinforcement rib situated in the interior area thereof;

and a plurality of longitudinal spaced apart deck boards in supporting connection with the stringers, each of the deck boards being formed from thermoplastic material, each of the deck boards in cross section having a board upper side and a board lower side connected by spaced board side walls, each of the deck boards further having a board interior area defined by the upper and lower sides and the side walls, each of the deck boards further having at least one board reinforcement rib situated in the interior thereof, at least one of the deck boards having a plurality of ridges on a board upper side and a board lower side.

2. A plastic pallet according to claim 1 wherein the stringers extend generally parallel to one another and in a first direction, and wherein the deck boards extend generally parallel to one another and in a direction generally transverse to the first direction.

3. A plastic pallet according to claim 2 wherein the deck boards are joined in fixed engagement with the stringer top walls of the stringers.

4. A plastic pallet according to claim 3 and, further comprising a plurality of lower deck boards positioned transversely underneath said stringers with the board upper side of each of the lower deck boards being joined in fixed engagement to the stringer bottom wall of each of said stringers.

5. A plastic pallet according to claim 3, wherein each deck board joined to a stringer top wall of a stringer further comprises a plurality of ridges, wherein the ridges extend on both the board upper side and board lower side thereof.

6. A plastic pallet according to claim 3 wherein the board lower side of the deck boards are fixed to the stringer top walls at a plurality of upper joining locations, and wherein at the upper joining locations at least one of the board lower sides or the stringer top wall includes ridges thereon.

7. A plastic pallet according to claim 6 and further comprising a plurality of lower deck boards, wherein the lower deck boards are in engagement with the stringer bottom walls of each of the stringers.

8. A plastic pallet according to claim 7 wherein the board upper side of each of the lower deck boards is joined in fixed relation to stringer bottom walls of the stringers at a plurality of lower joining locations, and wherein at least one of the board upper sides of the lower deck boards and the stringer bottom walls of the stringers include ridges in a lower joining location.

9. A plastic pallet according to claim 7, wherein at least one of the lower deck boards further includes chamfers on a board upper side of the lower deck board.

10. A plastic pallet according to claim 9 wherein the stringers and at least one lower deck board bound at least one fork access area, and wherein the chamfer extends in the fork access area and wherein the chamfer extends between a board upper side and a board side wall of the one deck board.

11. A plastic pallet according to claim 10 wherein the one deck board in the fork access area includes two chamfers, wherein one chamfer extends between each board side wall and the board upper side.

12. A plastic pallet according to claim 1, further comprising an end cap closing the stringer interior area on the stringers.

13. A plastic pallet according to claim 12 wherein the end cap is formed from thermoplastic material.

14. A plastic pallet according to claim 1, wherein the stringers and the deck boards bound at least one fork access area adapted for accepting lifting members therein, and wherein at least one of a board lower side and a stringer side wall bounding the fork access area includes ridges thereon.

15. A plastic pallet according to claim 14 wherein the fork access area has an opening, wherein the opening is configured so that a lifting member is extendable in generally a first direction in the opening, and wherein the ridges extend generally transverse to the first direction.

16. A plastic pallet according to claim 1, wherein the plastic pallet is constructed without mechanical fasteners.

17. A plastic pallet according to claim 1, wherein the plurality of ridges include at least one of either a surface including generally pointed projections, a dimpled surface, a roughened surface, a wave-like shape surface, a surface having high friction coating, a sinusoidal shape surface, and a surface including a co-extruded layer of high friction material.

18. A plastic pallet according to claim 1 wherein at least one stringer has an end, and further comprising an end cap, and wherein the end cap closes the stringer interior area at the end, and wherein the end cap includes at least two projecting portions, and wherein the projecting portions are joined in fixed engagement to at least two of the stringer side walls, the stringer top wall and the stringer bottom wall.

19. A plastic pallet according to claim 10 wherein the end cap comprises an outer plate portion overlying the stringer end and a pair of projecting portions extending from the outer plate portion, wherein each of the projecting portions overlies an outside surface of at least one of the stringer side walls.

20. A plastic pallet according to claim 19 wherein the projecting portions are in fixed engagement with the stringer side walls and extend along the stringer side walls a distance from the stringer end sufficient to resist tearing of the side walls adjacent the end.

21. A plastic pallet according to claim 20 wherein the outer plate portion is further joined in fixed engagement to a board lower side of a deck board.

22. A plastic pallet according to claim 21 wherein each of the projecting portions is joined in fixed engagement to a board lower side of a deck board.

23. A plastic pallet according to claim 22 and further comprising a lower deck board joined in fixed engagement adjacent the end of the stringer, wherein the lower deck board includes a board upper side joined to a stringer bottom wall of the stringer, and wherein the end cap is joined in fixed engagement to the lower deck board.

24. A plastic pallet according to claim 23 wherein the outer plate portion and both of the projecting portions of the end cap are joined in fixed engagement to the board upper surface of the lower deck board.

25. A plastic pallet according to claim 24 wherein the projecting portions are joined in fixed engagement to the walls a distance from the stringer end sufficient to prevent tears in the stringer walls at the stringer end.

26. A plastic pallet according to claim 18 wherein the projecting portions extend in the stringer interior area and are joined in fixed relation to at least two of the stringer side walls, the stringer top wall and the stringer bottom wall.

27. A plastic pallet according to claim 26 wherein the end cap is joined in fixed engagement to one of the deck boards.

28. A plastic pallet according to claim 1, wherein said stringers include openings extending through the stringer bottom wall, wherein the openings are sized and spaced to accept lifting members therein.

29. A plastic pallet according to claim 1, and further comprising shock absorbing means extending between at least two of the deck boards, whereby said shock absorbing means improves pallet durability.

30. A plastic pallet according to claim 1, further comprising an end cap closing the board interior of a deck board.

31. A plastic pallet according to claim 1, wherein the thermoplastic material is one of the group consisting of polyolefins, polyurethanes, polyvinylchloride, polystyrene, polypropylene, polyethylene, acrylonitrile-butadiene styrene, polyester resins, polyethylene terephthalate, high density polyethylene, low density polyethylene, post industrial recycled plastics, post consumer recycled plastics, filled polymers/blends, reinforced polymers/blends, cellular polymers/blends, and mixtures thereof.

32. A plastic pallet according to claim 31, wherein said stringers and said deck boards are formed from different thermoplastic materials.

33. A plastic pallet according to claim 1, wherein said stringers or deck boards are manufactured by a process type selected from the group consisting of extrusion, injection molding, compression molding, thermoforming, and blow molding.

34. A plastic pallet according to claim 1 made by a process comprising the steps of:

a) forming the plurality of thermoplastic stringers;

b) forming the plurality of thermoplastic deck boards;

c) attaching the stringers and deck boards in fixed connection without the use of fasteners.

35. A plastic pallet according to claim 34 wherein in step (a) the stringers are formed by at least one of extrusion, injection molding, compression molding, thermoforming and blow molding.

36. A plastic pallet according to claim 35, wherein step (b) comprises extruding at least one of the deck boards of a first material, and wherein step (b) further comprises coextruding at least one strip of a second material with one deck board, wherein the second material has lower hardness than the first material.

37. A plastic pallet according to claim 36, wherein the at least one deck board has an upper board side, and wherein step (b) includes coextruding the strip on the upper board side.

38. A plastic pallet according to claim 37 wherein the upper board side of the at least one deck board has an upper face, and wherein the strip extends upward beyond the upper face.

39. A plastic pallet according to claim 36, wherein the at least one deck board has a lower board side, and wherein step (b) includes extruding the strip on the lower board side.

40. A plastic pallet according to claim 36, wherein the at least one deck board has an upper board side anon lower board side, and wherein step (b) includes coextruding at least one strip on each of the upper board side and the lower board side.

41. A plastic pallet according to claim 34 wherein in step (b) the deck boards are formed by at least one of extrusion, injection molding, compression molding, thermoforming and blow molding.

42. A plastic pallet according to claim 34 wherein in step (c) the attaching is accomplished by at least one of adhesion, solvent welding, hot plate welding, microwave welding, ultrasonic welding and laser welding.

43. A plastic pallet according to claim 34, wherein the deck boards are comprised of a first material, and wherein the method of making further comprises attaching at least one non-slip member comprised of a second material to at least one of the deck boards, wherein the first material is relatively harder than the second material.

44. A plastic pallet according to claim 43, wherein step (b) includes forming a recess in an upper board side of the at least one deck board, and wherein the attaching step includes extending the non-slip member in the recess.

45. A plastic pallet according to claim 44, and wherein the attaching step includes adhering the non-slip member to the deck board with an adhesive.

46. A plastic pallet according to claim 1 wherein the deck boards are comprised of a first material, and wherein at least one of the deck boards includes at least one strip extending thereon, wherein the strip is comprised of a second material, and wherein the first material is harder than the second material.

47. A plastic pallet according to claim 46 wherein the at least one deck board includes an upper board side bounded by an upper face, and wherein the strip extends upward beyond the upper face.

48. A plastic pallet according to claim 46 wherein the at least one deck board includes an upper board side bounded by an upper face, and a lower board side bounded by a lower board face, and further comprising at least one upper strip in supporting connection with the upper board side and extending upward beyond the upper face, and at least one lower strip in supporting connection with the lower board side and extending downward below the lower face.

49. A plastic pallet constructed without mechanical fasteners, comprising:

a plurality of top deck boards, each of the top deck boards being formed from thermoplastic material, each of the top deck boards in cross section having a board upper side and a board lower side connected by spaced board side walls, each of the top deck boards further having a board interior area defined by the board upper side and the board lower side and the board side walls, a plurality of spaced apart stringers, each of the stringers being formed from thermoplastic material, each of the stringers in cross section having a pair of spaced stringer side walls connected by a stringer top wall and a stringer bottom wall, each of the stringers having a stringer interior area defined by the stringer side walls and the stringer top wall and the stringer bottom wall, a plurality of lower deck boards, each of the lower deck boards being formed from thermoplastic material, each of the lower deck boards in cross section having a board upper side and a board lower side connected by spaced board side walls, each of the lower deck boards further having a board interior area defined by the board upper side and the board lower side and the board side walls, wherein the top deck boards are joined in fixed engagement with the stringer top wall of each of the stringers at a plurality of upper joining locations, and wherein at the upper joining locations the board lower side and the stringer top wall each include ridges thereon;

wherein the lower deck boards are joined in fixed engagement with the stringer bottom wall of each of the stringers at a plurality of lower joining locations, and wherein at the lower joining locations the board upper side and the stringer bottom wall each include ridges thereon;

wherein the ridges facilitate engagement between the top and lower deck boards and the stringers, and wherein the ridges include at least one of either a surface including generally pointed projections, a dimpled surface, a roughened surface, a wave-like shape surface, a surface having high friction coating, a sinusoidal shape surface, and a surface including a co-extruded layer of high friction material.

* * * * *